US012187529B2

(12) United States Patent
Lemke et al.

(10) Patent No.: US 12,187,529 B2
(45) Date of Patent: Jan. 7, 2025

(54) METHODS OF MAKING, PACKAGING, AND DELIVERING COMPRESSED HOLLOW CORELESS REFORMABLE ROLL PRODUCTS

(71) Applicant: GPCP IP Holdings LLC, Atlanta, GA (US)

(72) Inventors: Sarah A. Lemke, Appleton, WI (US); Douglas E. Robinson, Grand Chute, WI (US); Thomas J. Daul, Oneida, WI (US); Pamela S. Mueller, Neenah, WI (US)

(73) Assignee: GPCP IP HOLDINGS LLC

( * ) Notice: Subject to any disclaimer, the term of this patent is extended or adjusted under 35 U.S.C. 154(b) by 847 days.

(21) Appl. No.: 17/142,793

(22) Filed: Jan. 6, 2021

(65) Prior Publication Data

US 2021/0122561 A1 Apr. 29, 2021

Related U.S. Application Data

(62) Division of application No. 14/942,866, filed on Nov. 16, 2015, now abandoned.

(Continued)

(51) Int. Cl.
*B65B 25/14* (2006.01)
*B65B 63/02* (2006.01)

(Continued)

(52) U.S. Cl.
CPC ..... *B65D 85/671* (2013.01); *B65B 63/02* (2013.01); *B65D 71/0092* (2013.01);

(Continued)

(58) Field of Classification Search
CPC ..... B65B 25/146; B65B 63/02; B65D 85/671; B65H 18/28; B65H 2701/18422; A47K 2010/3206

(Continued)

(56) References Cited

U.S. PATENT DOCUMENTS 325,410 A 9/1885 Hicks
864,975 A 9/1907 Luce (Continued)

FOREIGN PATENT DOCUMENTS

CN 2015-19097 U 7/2010
EP 0728067 A1 8/1996

(Continued)

OTHER PUBLICATIONS

Extended European Search Report for European Patent Application No. 15861358.8, Oct. 9, 2018, (15 pages), European Patent Office, Munich, Germany.

(Continued)

*Primary Examiner* — Stephen F. Gerrity

(57) ABSTRACT

A compressed hollow coreless roll of absorbent paper sheet produced by way of providing a roll of absorbent paper sheet by winding the sheet about a forming core member having a diameter in the range of 30 mm to 50 mm; removing the forming core member such that there is provided a hollow coreless roll of absorbent paper sheet with an axial cavity having a diameter in the range of 30 mm to 50 mm and compressing the hollow coreless roll such that the axial cavity is substantially collapsed. The compressed hollow coreless rolls are readily re-formed into cylindrical shape. Space-saving packages of the rolls are overwrapped with tubular polymer film to provide a flexible reconfigurable package of a series of individually encased rolls. Volume reductions of about 10 to about 20%, about 14% to about 20%, 30%, 40% and more as compared with conventional products are realized.

23 Claims, 22 Drawing Sheets

Related U.S. Application Data

(60) Provisional application No. 62/080,822, filed on Nov. 17, 2014.

(51) Int. Cl.

| | |
|---|---|
| ***B65D 71/00*** | (2006.01) |
| ***B65D 71/06*** | (2006.01) |
| ***B65D 77/02*** | (2006.01) |
| ***B65D 85/07*** | (2017.01) |
| ***B65D 85/671*** | (2006.01) |
| ***B65H 18/28*** | (2006.01) |
| *A47K 10/32* | (2006.01) |

(52) U.S. Cl.
CPC ..... *B65D 71/063* (2013.01); *B65D 77/02* (2013.01); *B65D 85/07* (2018.01); *B65H 18/28* (2013.01); *A47K 2010/3206* (2013.01); *B65B 25/146* (2013.01); *B65D 2571/00012* (2013.01); *B65D 2571/00018* (2013.01); *B65D 2571/00037* (2013.01); *B65H 2701/18422* (2013.01)

(58) Field of Classification Search
USPC ..... 53/430, 438, 118, 529
See application file for complete search history.

(56) References Cited

U.S. PATENT DOCUMENTS

| | | | | |
|---|---|---|---|---|
| 2,537,588 | A | 1/1951 | Husson | |
| 3,202,276 | A | 8/1965 | Burt et al. | |
| 3,537,226 | A | 11/1970 | Le Van et al. | |
| 3,823,887 | A | 7/1974 | Gerstein | |
| 3,853,279 | A | 12/1974 | Gerstein | |
| 4,487,378 | A | 12/1984 | Kobayashi | |
| 4,762,061 | A | 8/1988 | Watanabe et al. | |
| 4,765,474 | A | 8/1988 | James et al. | |
| 4,783,015 | A * | 11/1988 | Shimizu | A47K 10/16 242/160.1 |
| 4,886,167 | A | 12/1989 | Dearwester et al. | |
| 4,909,388 | A | 3/1990 | Watanabe | |
| 5,027,582 | A | 7/1991 | Dearwester | |
| 5,186,099 | A | 2/1993 | Qing et al. | |
| 5,195,300 | A | 3/1993 | Kovacs et al. | |
| 5,271,137 | A | 12/1993 | Schutz et al. | |
| 5,271,575 | A | 12/1993 | Weinert | |
| 5,281,386 | A | 1/1994 | Weinert | |
| 5,352,319 | A | 10/1994 | Ishizu et al. | |
| 5,387,284 | A | 2/1995 | Moody et al. | |
| 5,407,509 | A | 4/1995 | Ishizu et al. | |
| 5,451,013 | A | 9/1995 | Schutz | |
| 5,453,070 | A | 9/1995 | Moody et al. | |
| 5,467,935 | A | 11/1995 | Moody | |
| 5,467,936 | A | 11/1995 | Moody | |
| 5,474,436 | A | 12/1995 | Yamazaki | |
| 5,480,060 | A | 1/1996 | Blythe | |
| 5,518,200 | A | 5/1996 | Kaji et al. | |
| 5,577,686 | A | 11/1996 | Moody | |
| 5,620,148 | A | 4/1997 | Mitchell | |
| 5,639,046 | A | 6/1997 | Biagiotti | |
| 5,690,296 | A | 11/1997 | Biagiotti | |
| 5,697,576 | A | 12/1997 | Bloch et al. | |
| 5,722,608 | A | 3/1998 | Yamazaki et al. | |
| 5,730,387 | A | 3/1998 | Yamazaki | |
| 5,746,379 | A | 5/1998 | Shimizu | |
| 5,839,680 | A | 11/1998 | Biagiotti | |
| 5,848,762 | A | 12/1998 | Reinheimer | |
| 5,849,357 | A | 12/1998 | Andersson | |
| 5,875,985 | A | 3/1999 | Cohen et al. | |
| 5,894,708 | A | 4/1999 | Newby et al. | |
| 5,904,316 | A | 5/1999 | Dunning et al. | |
| 6,070,821 | A | 6/2000 | Mitchell | |
| 6,077,590 | A | 6/2000 | Archer et al. | |
| 6,082,664 | A * | 7/2000 | Phelps | A47K 10/38 242/596.7 |
| 6,425,547 | B1 | 7/2002 | Singh | |
| 6,439,502 | B1 | 8/2002 | Gemmell et al. | |
| 6,695,245 | B1 | 2/2004 | Schultz et al. | |
| 6,896,767 | B2 | 5/2005 | Wilhelm | |
| 7,316,369 | B2 | 1/2008 | Phelps | |
| 7,428,966 | B2 * | 9/2008 | Goodall et al. | B65D 85/672 206/226 |
| 7,513,453 | B2 | 4/2009 | Cattacin et al. | |
| 7,568,653 | B2 | 8/2009 | Zeiron et al. | |
| 7,992,818 | B2 | 8/2011 | Maddaleni et al. | |
| 8,287,986 | B2 | 10/2012 | Huss et al. | |
| 8,535,780 | B2 | 9/2013 | Wojcik et al. | |
| 8,783,600 | B1 | 7/2014 | Myron et al. | |
| 9,227,281 | B1 | 1/2016 | Meadows | |
| 9,365,376 | B2 | 6/2016 | Wojcik et al. | |
| 2006/0054672 | A1 | 3/2006 | Ichikawa et al. | |
| 2007/0054082 | A1 | 3/2007 | Beyer et al. | |
| 2007/0095693 | A1 | 5/2007 | De Luca | |
| 2009/0057169 | A1 | 3/2009 | Kruchoski et al. | |
| 2009/0057456 | A1 | 3/2009 | Shannon et al. | |
| 2011/0095116 | A1 | 4/2011 | Hada et al. | |
| 2011/0210199 | A1 | 9/2011 | Sinsabaugh | |
| 2012/0104142 | A1 | 5/2012 | Phelps | |
| 2012/0205272 | A1 | 8/2012 | Heilman et al. | |
| 2013/0225382 | A1 | 8/2013 | Haque et al. | |
| 2013/0299622 | A1 | 11/2013 | Trainer et al. | |
| 2020/0104142 | A1 | 4/2020 | Waga et al. | |

FOREIGN PATENT DOCUMENTS

| | | | | |
|---|---|---|---|---|
| EP | 2485973 | A2 | 8/2012 | |
| GB | 709363 | A | 5/1954 | |
| GB | 2120206 | A | 11/1983 | |
| GB | 2270667 | A | 3/1994 | |
| GB | 2228463 | A | 8/2020 | |
| JP | S5526922 | Y2 | 6/1980 | |
| JP | 58224941 | A | 12/1983 | |
| JP | S59194722 | U | 11/1984 | |
| JP | S624159 | Y2 | 1/1987 | |
| JP | H02296633 | A | 12/1990 | |
| JP | 5337060 | A | 12/1993 | |
| JP | 6171807 | A | 6/1994 | |
| JP | H06171808 | A | 6/1994 | |
| JP | H06181857 | A | 7/1994 | |
| JP | H06189870 | A | 7/1994 | |
| JP | 6247596 | A | 9/1994 | |
| JP | 6329310 | A | 11/1994 | |
| JP | H725894 | U | 5/1995 | |
| JP | H07115781 | B2 | 12/1995 | |
| JP | 9118455 | A | 5/1997 | |
| JP | 2000177894 | A * | 6/2000 | B65H 2701/1846 |
| JP | 2000/229046 | A | 8/2000 | |
| JP | 2003-93266 | A | 4/2003 | |
| JP | 2003093266 | A * | 4/2003 | |
| JP | 2003-292028 | A | 10/2003 | |
| JP | 2005-102863 | A | 4/2005 | |
| JP | 2006-149600 | A | 6/2006 | |
| JP | 2013-70815 | A | 4/2013 | |
| JP | 3193779 | U | 10/2014 | |
| JP | 2002/240990 | A | 2/2021 | |
| WO | WO-88/10220 | A1 | 12/1988 | |
| WO | WO-95/13183 | A1 | 5/1995 | |
| WO | WO-95/24147 | A1 | 9/1995 | |
| WO | WO-0059353 | | 10/2000 | |
| WO | WO-2006/098663 | A1 | 9/2006 | |
| WO | WO-2007/045451 | A1 | 4/2007 | |
| WO | WO-2009/027874 | A1 | 3/2009 | |
| WO | WO-2011/158265 | A1 | 12/2011 | |

OTHER PUBLICATIONS

First Office Action for Chinese Application No. 201580062415.4, Oct. 29, 2018, (33 pages), China National Intellectual Property Administration, Beijing, China.

(56) References Cited

OTHER PUBLICATIONS

International Preliminary Report On Patentability for International Application No. PCT/US2015/061030, May 23, 2017, (15 pages), The International Bureau of WIPO, Geneva, Switzerland.
International Search Report and Written Opinion of the International Searching Authority for International Application No. PCT/US2015/061030, Feb. 24, 2016, (16 pages) Korean Intellectual Property Office, Republic of Korea.
Office Action for Japanese Application No. 2017-544860, Aug. 7, 2019, (38 pages), Japanese Patent Office, Tokyo, Japan.
Partial Supplementary European Search Report for European Patent Application No. 15861358.8, Jul. 6, 2018, (13 pages), European Patent Office, Munich, Germany.
Second Office Action for Chinese Application No. 201580062415.4, Jul. 4, 2019, (31 pages), China National Intellectual Property Administration, Beijing, China.
European Examination Report, Communication Pursuant to Article 94(3) EPC for European Patent Application No. 15861358.8, Jan. 19, 2021, (6 pages), European Patent Office, Rijswijk, Netherlands.

* cited by examiner

METHODS OF MAKING, PACKAGING, AND DELIVERING COMPRESSED HOLLOW CORELESS REFORMABLE ROLL PRODUCTS

CROSS-REFERENCE TO RELATED APPLICATIONS

This application is a divisional of and claims priority to and the benefit of U.S. Nonprovisional patent application Ser. No. 14/942,866, filed Nov. 16, 2015; which application further claims priority to and the benefit of U.S. Provisional Patent Application Ser. No. 62/080,822, filed Nov. 17, 2014; the entire contents of both of which as are hereby incorporated by reference in their entireties.

BACKGROUND

Related Field

The present invention relates to roll products and, in a preferred embodiment, to compressed and hollow coreless rolls of absorbent paper products such as tissue and toweling, commonly referred to as tissue, in flexible packaging that enables the manufacturer to ship a larger usable area of tissue in a given volume while enabling the end user to store tissue in nooks and crannies that might not be suitable for tissue packaged in conventional configurations.

Related Art

Transportation costs add substantially to the cost of absorbent paper products sold for consumer use as the volume of these products is such that when the entire allowable space in a trailer or container is filled with product, the weight is typically far less than the load carrying capacity of the trailer or container. Prime contributors to the excessive volume of these products are the central void which is typically around 40 mm or so and also to a lesser extent the generally cylindrical external shape of the overall product. In practice, when an array of absorbent products is packaged in a polyethylene overwrap, the exteriors of the roll are flattened to some extent, increasing the packability of the array of rolls over that which would be predicted based solely on the uncompressed roll diameter. It seems that consumers do not find such rolls objectionable, most likely due to substantial recovery of the cylindrical shape resulting from the resilient nature of absorbent paper products. However, efforts to eliminate the excess volume contributed by the hollow center void have been less successful in consumer markets, as rolls that have been compressed sufficiently to eliminate the hollow center space apparently do not recover their overall cylindrical shape sufficiently to satisfy consumers' aesthetic demands.

It is known to compress rolled goods to reduce volume which is advantageous for transportation and storage. There is disclosed, for example, in U.S. Pat. No. 864,975 to Luce, a method and apparatus for baling cotton in sheet form. The method includes baling the cotton around a mandrel, removing the mandrel, followed by compressing the annular bale so formed. So also, U.S. Pat. No. 3,537,226 to Le Van et al. discloses a method of packaging batts of textile fibers, including: (a) wrapping the initial batt onto a rigid core to form a cylindrical structure; (b) encasing the structure with a bag of an air impervious material and removing the core; (c) evacuating air from the bag to contract the structure and to increase the initial batt density; and then (d) wrapping the contracted structure with a wrapper of sufficient tensile strength to maintain substantially the contracted state.

U.S. Pat. No. 5,480,060 to Blythe shows a system for dispensing wipers which includes a bi-directionally compressed hollow coreless roll of wipers configured for center-feed dispensing.

Bath tissue is sometimes produced in hollow coreless roll form, typically with a very small axial central cavity (see U.S. Pat. No. 4,487,378 to Kobayashi) to minimize volume, or with a larger central cavity when the tissue roll is configured for center-feed dispensing. See U.S. Pat. No. 5,849,357 to Andersson. Such products have not been popular with consumers who prefer rolled bath tissue with a relatively large core, outer roll-feed for home use where the product is mounted about a spindle. Typically bath tissue rolls are provided with a core having a diameter of 40 mm or so consisting of a paperboard tube which adds cost, weight and volume to the product. Production efficiency deficits are also associated with tissue having a large core which are often formed on center wind equipment operating at lower winding speeds than surface winders often employed to produce hollow coreless products.

U.S. Pat. No. 4,886,167 to Dearwester discloses compressed rolls of absorbent sheet with conventional paperboard tubular cores. It has been found that this type of product often does not recover well from compression; as re-shaping to cylindrical roll form can be quite difficult, possibly due, in part, to the difficulty of removing creases from the paperboard core after it has been flattened.

U.S. Pat. No. 7,992,818 to Maddaleni relates to a technique for forming rolls of tissue having a large central opening on high speed winders without the expense of a board tube. Rather by providing a discontinuity or low friction interface between adjacent layers in the wound roll, it becomes possible to remove a central plug or small diameter roll of tissue located interiorly to the discontinuity or low friction interface after the roll has been formed. The central plug is a product usable in its own right after removal from the larger roll, particularly where a small, easily carried around supply of tissue is desirable as in a lady's purse for example.

BRIEF SUMMARY

There is provided in accordance with the invention compressed hollow coreless rolls of absorbent paper sheet having a substantially collapsed central axial cavity. Prior to use, the roll is re-formed into cylindrical shape and subsequently mounted about a spindle for dispensing. Optionally, a tubular dispensing core with a diameter smaller than the original cavity before collapse is provided which may be inserted into the hollow coreless roll after it is re-formed into cylindrical shape and prior to dispensing. Such a core can suitably be 2-50% smaller, preferably 10-50% smaller, more preferably 15 to 40% smaller than the original cavity before collapse and is preferably re-usable, although single use or several use adaptors are employable as well.

A particularly significant aspect of the invention is the reduced volume of a package as compared with a package of conventional rolls of cored product with the same weight and sheet count. Volume reductions of about 10 to about 20%, about 14% to about 20%, 30%, 40% and more are realized while delivering the same quality and quantity of product without incurring excessive aesthetic objections. In one particularly popular format, we have found that we can increase the amount of tissue (rolls of specified width and length) which can be loaded into a 96" wide trailer having a length of 608" and a height of 104" can be increased by over 35% by use of compressed hollow coreless re-formable roll products of the present invention as compared to conventional cylindrical cored products.

The central cavity of the hollow coreless roll, prior to compression of the roll, is typically cylindrical with a diameter in the range of 25-75 mm. The invention is superior to core-in compressed products in terms of reduced weight and in terms of re-formability of the central cavity as will be appreciated from the discussion provided hereinafter.

In contrast to conventional hollow coreless products with small central axial cavities, the invention product has a relatively large central cavity and the product is much more compressible, making available the benefits in terms of volume reduction and product shape. Conventional hollow coreless products are also difficult to re-shape after compression to a stable "round" shape.

Moreover, the present invention makes it possible to overcome consumer negatives associated with producing desirable combinations of sheet count and caliper without needing to achieve specific roll diameter requirements. Current rolled products have desired roll diameters for specific characterizations like "Regular Roll", "Large Roll", Big Roll", "Giant Roll", Mega Roll", "Super Roll", "Double Roll" and similar other size related descriptions. As sheet counts are reduced, it becomes more and more difficult to achieve the desired roll diameter, whether by increasing base sheet caliper, finished product caliper (i.e., through more emboss, higher basis weight, high bulk forming), or through winding the roll in a way that results in a large diameter, but low overall fiber weight, roll.

By compressing a hollow coreless roll, the need to balance the sheet count, forming, caliper, embossing, and roll winding process to achieve the desired roll diameter is eliminated, as compressed rolls will not have the same roll diameter requirements as conventional rolled product. This will result in more cost-effective papermaking and converting processing of the base sheet and finished product, as well as more efficient transportation of these compressed rolls.

The present invention also provides for multiple packaging options for a plurality of rolls. Packages of multiple rolls in accordance with the invention require less storage space and can be configured to fit into spaces not suitable for conventional products; making it possible to better utilize available storage areas in the home or in a business establishment. Significantly, the tissue rolls in the compressed configurations also adapt well to limited storage and display spaces found in retail environments. Savings in transportation costs can be of immense importance commercially.

In one particularly attractive embodiment, each roll of compressed absorbent paper product may be wrapped in a polyethylene film formed from a tube flattened and heat sealed between rolls so that each roll is ensconced in its own separate sub package while a linear array of wrapped rolls may be manipulated like a string of sausages to adapt to storage in oddly sized or configured spaces that may be available. In many cases, it will be convenient to provide two heat sealed regions separated by one line of weakness in the portion of the tube between adjacent rolls so that the rolls may be easily separated from the linear array while remaining individually sealed from the environment. Preferably the distance between at least some of adjacent rolls will be at least substantially equal to the transverse dimension (width) of the compressed roll to make it convenient to dispose the rolls in serpentine configurations.

In some embodiments, each individualized roll will bear a transverse circumferential band to stabilize the compression. Such a band may comprise paper, a similar nonwoven or a polymeric film. In most cases it will be expedient to secure the transverse band by interposing pressure sensitive adhesive between overlapping ends thereof. In other cases, particularly where the hollow compressed rolls are packaged in a long polymeric tube as described above, that packaging will itself be sufficient to retain the rolls in the compressed configuration.

In some cases, it may be expedient to compress the rolls using opposed pistons. In other cases, the rolls may be compressed by forcing them through a suitably shaped chute.

Still further features and advantages will become apparent from the discussion which follows.

BRIEF DESCRIPTION OF THE SEVERAL VIEWS OF THE DRAWINGS

The invention is described in detail below with reference to the drawings wherein like numerals designate similar parts.

DETAILED DESCRIPTION

The invention is described in detail below in connection with the various Figures for purposes of illustration, only. The invention is defined in the appended claims. Terminology used throughout the specification and claims herein are given their ordinary meanings as supplemented immediately below.

Figure 1A:
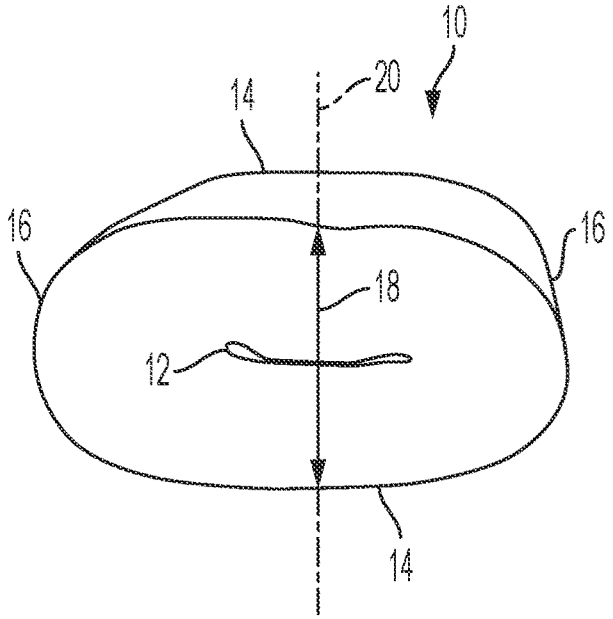
FIG. 1A illustrates a compressed hollow coreless roll of bath tissue of the invention.

When we refer to the axial cavity of the product as "substantially collapsed", the reference is to a flattened form as shown in FIG. 1A. Preferably, the gap between opposing sides of the cavity in the substantially collapsed configuration is less than 25 mm, preferably less than 10 mm, more preferably less than 5 mm and still more preferably less than 2 mm on average. In a preferred embodiment, opposing sides of the collapsed cavity are in contact over a major portion of their area, preferably over at least about 60%, more preferably over at least about 70%, even more preferably over at least about 80%, and most preferably at least about 90%, when rolls are in the compressed state in which they are shipped.

"Tissue" rolls or similar terminology refers to cellulosic fiber tissue products, while "bath tissue" rolls must be flushable and are typically manufactured without a substantial amount of permanent wet strength resin; as opposed to paper toweling, or kitchen roll towel, which has a substantial amount of wet strength resin. Moreover, the most preferred bath tissue is predominantly (over 50% dry weight) composed of hardwood fiber such as *eucalyptus* fiber, although many grades, particularly commercial and economy grades, have ever increasing recycled content of uncertain origin. Bath tissue generally has a basis weight of anywhere from 8 to 35 lbs per 3000 square foot ream, with 2 and 3 ply products typically having a basis weight of from 20 to 35 lbs per 3000 square foot ream. Details and various properties of bath tissue are presented in U.S. Pat. No. 8,287,986 to Huss et al. As mentioned previously, similar savings and advantages are also realizable with kitchen roll towel as well as any absorbent paper product sold in roll form. Preferably, the invention is employed with respect to absorbent papers in which the sheets are not spoiled or defaced by the compression process. Accordingly, the invention can be employed with bath tissue, kitchen roll towel, other paper toweling formats, or even napkin stock.

In the various packaging configurations hereinafter described and shown in the drawings, relative orientation of the compressed rolls in the package is specified, in part, by reference to a central axis of the collapsed axial cavities of the compressed rolls which corresponds to the axis of the forming core member upon which the sheet is wound during manufacture and/or converting. Relative orientation is also sometimes specified by reference to either longer or shorter sides of the compressed rolls.

Referring to FIG. 1A, there is shown a compressed hollow coreless roll 10 of absorbent paper sheet produced by way of providing a roll of absorbent paper sheet by winding the sheet about a forming core member having a diameter in the range of 25 mm to 50 mm; removing the forming core member such that there is provided a hollow coreless roll of absorbent paper sheet with an axial cavity having a diameter in the range of 25 mm to 50 mm and compressing the hollow coreless roll such that the axial cavity is substantially collapsed. When we refer to a "hollow" compressed roll, we are referring to a roll of tissue from which either a conventional cylindrical board stock tube has been removed or a roll of tissue from which the central portion of the roll has been removed leaving a hollow cavity therethrough. Note the absence of any hollow cylindrical board stock core in central cavity 12 of the compressed hollow coreless roll 10 of FIG. 1A.

Prior to compression, central plugs are preferably removed from substantially hollow coreless rolls using the procedures such as those described in U.S. Pat. No. 7,992,818 to Maddaleni, Aug. 9, 2011 (incorporated herein by reference). Subsequent to core removal, hollow coreless roll 8 may be compressed by action of opposed pistons 70, 72 bearing against lateral surfaces of the rolls as illustrated in FIGS. 11A through 11D, resulting in compressed hollow coreless roll 10. Alternatively, a single piston bearing against a roll restrained by a fixed wall may be used.

Typically, the plug removed has a diameter of from about 15 mm to 45 mm such that the axial cavity of the roll has a diameter of from 15 mm to 45 mm prior to compression of the roll, and in some embodiments the forming core member has a diameter of from about 37.5 mm to 42.5 mm such that the axial cavity of the roll has a diameter of from 37.5 mm to 42.5 mm prior to compression of the roll.

The forming core member may be a tubular paperboard core or any other suitable collapsible core member, but the forming core is preferably removed prior to completion of roll compression in order to facilitate both compression and re-forming as will be appreciated from the Figures. In some cases, initial compression of the roll while still retaining the core may facilitate removal of the core, particularly if the roll is formed around a conventional paperboard core rather than being formed directly on a mandrel or on a collapsible mandrel. In the cases in which the product of the present invention is formed from a substantially hollow coreless roll, it will generally be preferable to remove the central plug from the roll prior to compression thereof. However, advantageously there is no necessity to remove the central plug prior to sawing of individual rolls prior to the log saw.

In FIG. 1A, compressed hollow coreless roll 10 maintains a flattened shape having: a substantially collapsed central cavity 12, a pair of longer sides 14 which may be relatively flattened and may have a central portion which approaches being generally planar; a pair of shorter sides 16, which, at least after initial compression, are more rounded and may even approach being generally semi-cylindrical. The compressed hollow coreless roll 10 is characterized largely by a thickness 18 measured from the perpendicular longer sides 14 through the central axis 20 of the substantially collapsed central cavity 12 which corresponds to the central axis of the forming core member about which the absorbent sheet was wound.

Figure 1B:
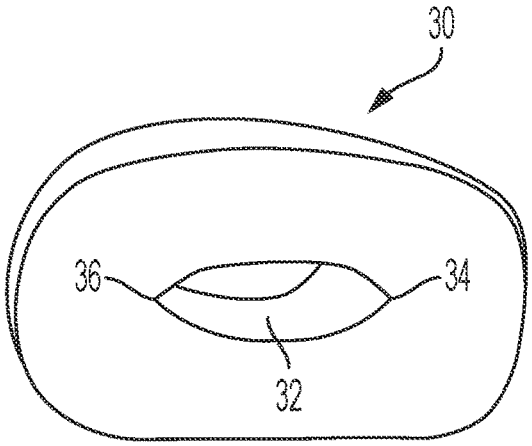
FIG. 1B illustrates a compressed roll of bath tissue with a paperboard core prepared by the same method of compression as the roll of FIG. 1A.

There is shown in FIG. 1B compressed roll 30 of bath tissue which was compressed with tubular forming core 32 remaining in place, otherwise following the same procedure as was used to compress hollow coreless roll 10. It is seen in FIG. 1B that compressed roll 30 does not maintain a flattened shape nearly as well as compressed hollow coreless roll 10 and that forming core 32 appears creased around its lateral edges, especially at edge 34 and 36. On the other hand, compressed hollow coreless roll 10 maintains a flatter shape which is much more desirable in terms of volume reduction, and package consistency, package compressibility, and residual force the roll might exert upon a package after wrapping.

Figure 2A:
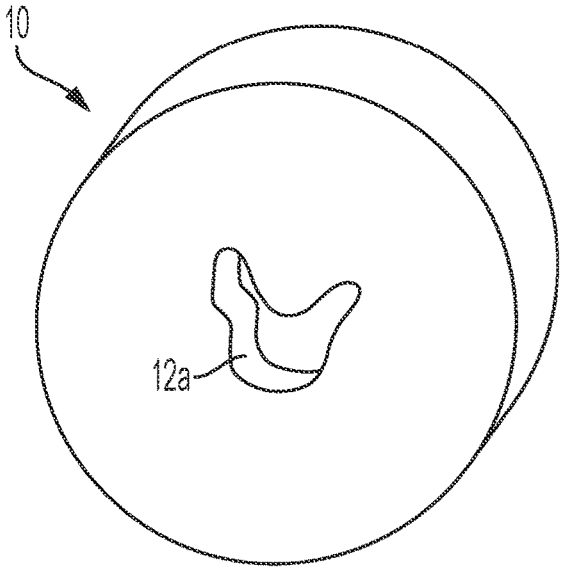
FIG. 2A illustrates a re-formed hollow coreless roll of bath tissue in accordance with the invention.
Figure 2B:
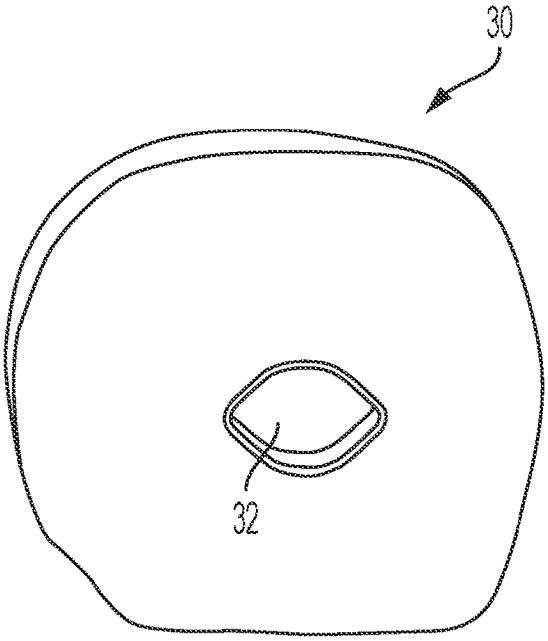
FIG. 2B illustrates a re-formed roll of bath tissue with a paperboard core.

In FIGS. 2A and 2B there is shown the rolls of FIGS. 1A and 1B, respectively, after re-forming by simple application of hand pressure, principally on the shorter sides of the rolls. It can be seen that compressed hollow coreless roll 10 recovers a much more cylindrical shape than compressed roll 30, which presents a far more irregular shape largely occasioned by the easily visible resistance of forming core 32 to re-shaping. If desired by the consumer, cavity 12 *a* may be further re-shaped by hand prior to mounting on a spindle for dispensing or a by dispensing core, such as re-useable core 40 shown in FIGS. 3A though 3C, which may be inserted prior to mounting the roll on a spindle.

Figure 3A:
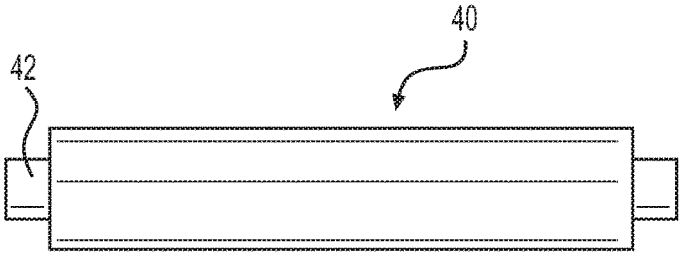
FIGS. 3A, 3B and 3C are views in perspective of a re-usable core which may be used for dispensing tissue from the roll of FIG. 2A.
Figure 3B:
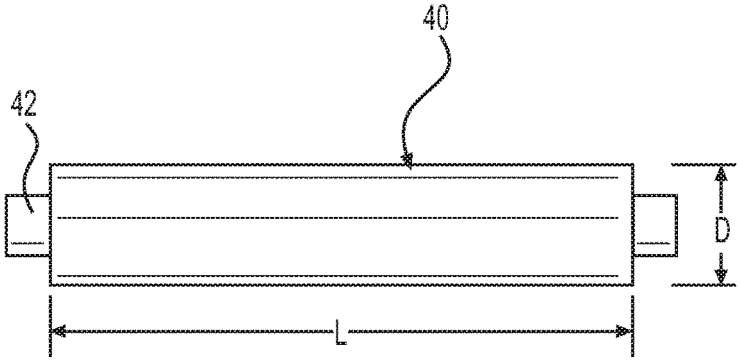
Figure 3C:
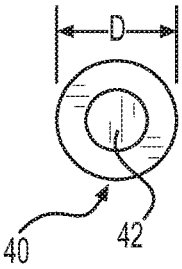

In FIGS. 3A though 3C, re-usable core 40 is a tubular core of a length, L, corresponding to the length of the bath tissue roll, preferably slightly longer, and has a diameter, D, which is typically smaller than the diameter of the forming core member about which compressed hollow coreless roll 10 was originally formed. In this regard, the forming core member about which compressed hollow coreless roll 10 was originally formed may be a paperboard core (such as forming core 32, FIG. 2B) which may have a diameter of about 1.6 inches (41 mm), while the diameter, D, of re-useable core 40 may be in the range of from 1 to 1.25 inches (or about 25-40 mm) The forming core may be tubular, cylindrical or other suitable shape, in which case "diameter" refers to the maximum lateral dimension of the forming core member. As is conventional, re-usable core 40 is placed around a spindle or rod having spring loaded retractable end pieces 42 to enable re-usable core 40 with a roll of tissue about it to be mounted in conventional holders. Expandable spindles adapted to urge the central cavity toward a more cylindrical shape such as that shown in FIGS. 19A through 19F may be used particularly by homemakers concerned about the aesthetic appearance of the product in the roll holder.

The compressed products of the invention have significantly less volume than corresponding products provided with a core and may be packaged in various individually wrapped sub packaged configurations, preferably overwrapped with a polymeric film effective to maintain the compressed roll in a substantially collapsed configuration, as shown in FIG. 1A. While any convenient polymeric film having sufficient strength may be used, preferably the film may be a polyethylene or polypropylene film, if so desired. The invention is particularly suitable for bath tissue and kitchen roll towel rolls from which the central plug has been removed.

A hollow coreless tissue roll of the present invention suitably has a diameter of from about 80 mm to 230 mm prior to compression, and a thickness after compression such that after its axial cavity is substantially collapsed, it has a thickness of no more than about 90%, preferably no more than about 85%, preferably no more than about 80%, preferably no more than about 70% and more preferably no more than about 60%, still more preferably no more than about 55% of the diameter of the roll prior to compression and still more preferably, a thickness after compression of no more than about 50% of the diameter of the roll prior to compression. A particularly preferred hollow coreless tissue roll has a diameter of from about 100 mm to 230 mm prior to compression and a thickness after compression such that its axial cavity is substantially collapsed to no more than about 60% of the diameter of the roll prior to compression. The tissue, whether kitchen roll towel or bath tissue, may be 2-ply or 3-ply product or, if a suitable high-bulk forming method is used even single ply.

The products of the invention are typically provided in a package containing a plurality of the compressed hollow coreless rolls which are overwrapped with a polymeric film, wherein the polymeric film is effective to maintain the axial cavities of the plurality of hollow coreless rolls in the substantially collapsed configuration. Optionally, the package contains a re-usable tubular dispensing core such as re-usable core 40 which has a diameter smaller than the forming core member upon which the roll was wound. Re-usable core 40 may have a diameter of from 25 mm to 32 mm, or from 2 to 50% less than the axial cavity, and may, if so desired, be perfumed, or may be manufactured from a water-dispersible material. In some embodiments, the tubular dispensing core is colored with a pigment or die, wherein the pigment or dye is of a color selected from red, yellow, blue, green, cyan, magenta and combinations thereof, or white if pigmented with $TiO_2$.

Packages of product in accordance with the invention, consisting of rolls of absorbent sheet overwrapped with a polymeric film, occupy much less space than corresponding conventional cored products and also have less weight due to the absence of a core. Weight benefits are of anywhere from 5 to 15% or even 25%, over conventional products, saving transportation costs. The benefits with respect to decreased occupied volume are much more dramatic ranging anywhere from 25 to 45%, as can be appreciated from FIGS. 4 through 10G.

The product of the invention provides dramatic volume reductions in comparison with conventional 2×2 package dimensions of 24×12×20. This can be appreciated from the variety of packaging arrangements having drastically different package dimensions illustrated in FIGS. 10A through 10G.

Figure 4:
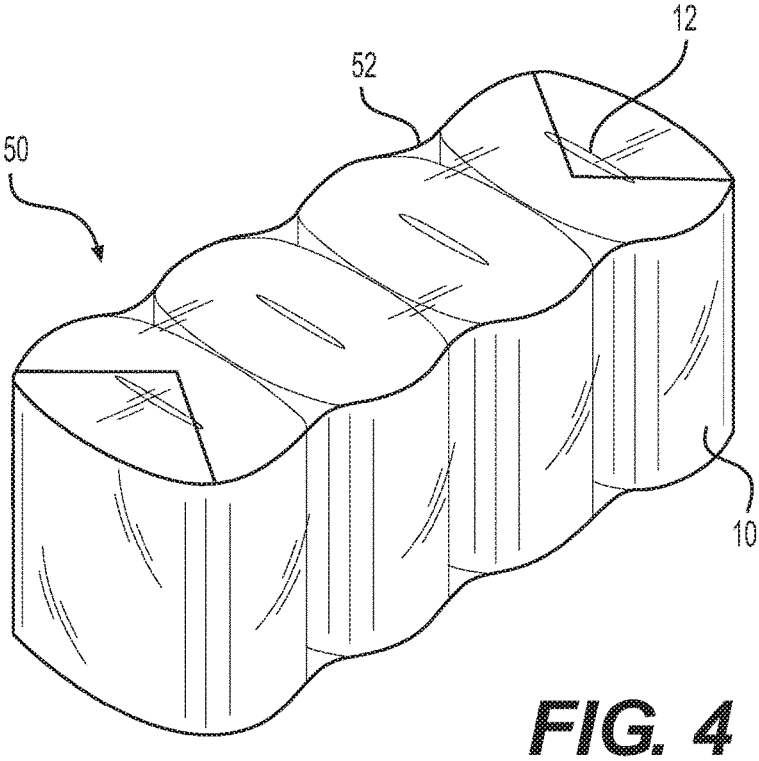
FIG. 4 illustrates a package which contains four rolls disposed in a 1×4 planar array with the collapsed axial cavities of the compressed rolls arranged in parallel and the longer sides of the compressed rolls arranged in facing relationship.

FIG. 4 illustrates a package 50 which contains four compressed hollow coreless rolls 10 disposed in a 1×4 planar array with collapsed axial central cavities 12 of compressed hollow coreless roll 10 arranged in parallel and the longer sides of the compressed rolls arranged in facing relationship. The rolls are overwrapped with polymer film 52. It can be appreciated from FIG. 10A that this configuration provides a volume savings of 42% with respect to a conventional four roll package.

Figure 5:
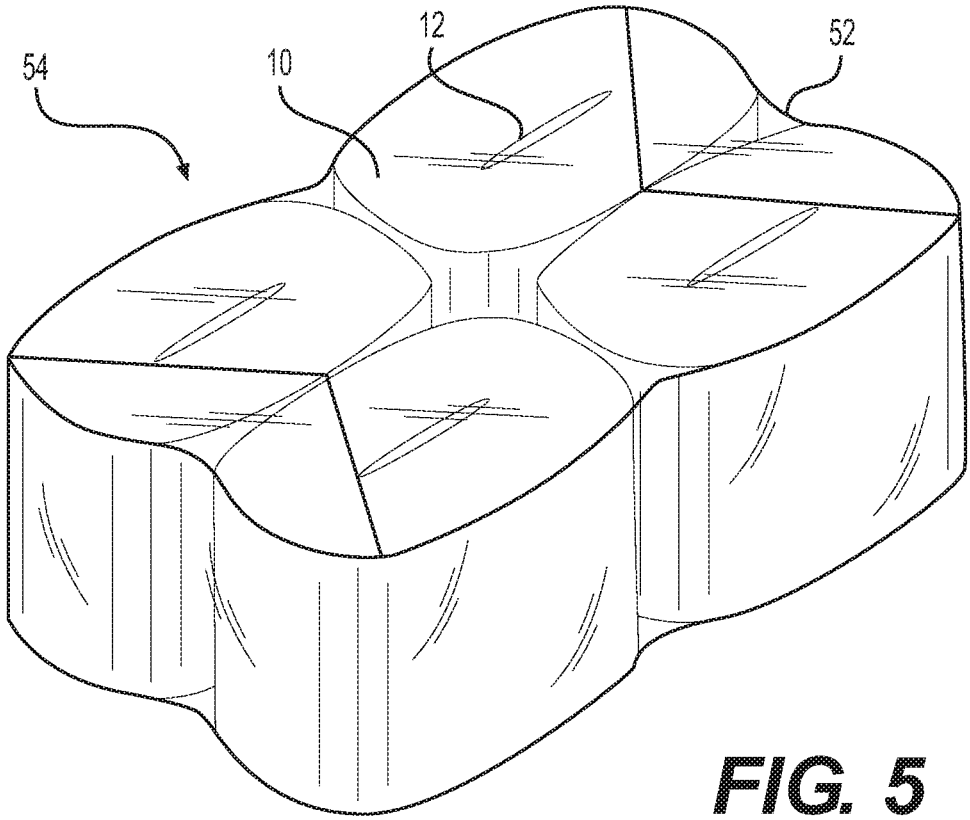
FIG. 5 illustrates a package which contains four compressed rolls disposed in a 2×2 planar array with the collapsed axial cavities of the compressed rolls arranged in parallel.
Figure 10A:
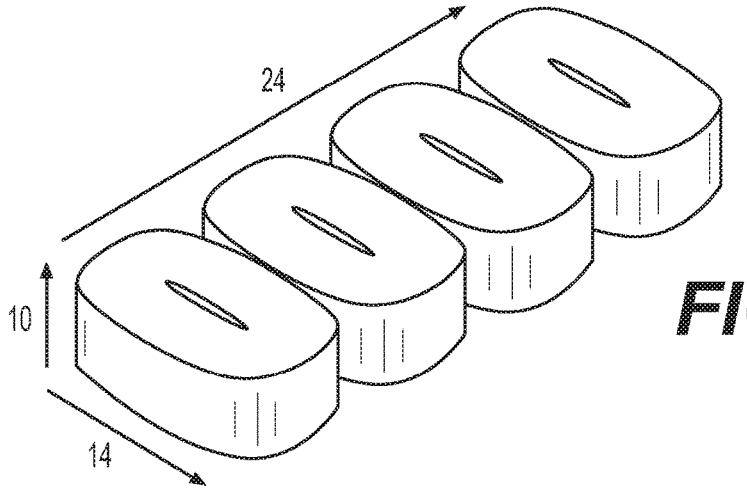
FIGS. 10A through 10G are schematic diagrams which illustrate volume savings of the invention products as compared with uncompressed product having a paperboard tubular core packaged in a 2×2 planar array. It can be appreciated that savings in volume extend over a wide variety of configurations from single rolls up to over-wrapped pre-packaged store displays holding hundreds of rolls of tissue in any of a variety of subpacks on a single pallet that can be simply positioned on the retail floor and sold individually after removal of the overwrap.
Figure 10B:
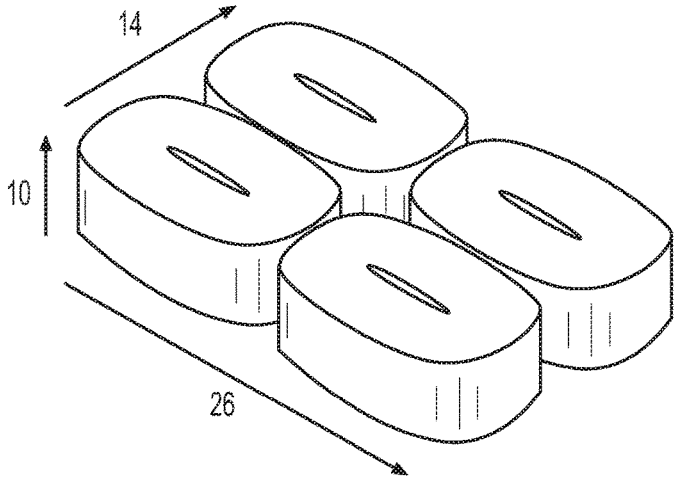

FIG. 5 illustrates a package 54 which contains four compressed hollow coreless rolls 10 disposed in a 2×2 planar array with the collapsed axial central cavities 12 of the compressed rolls arranged in parallel. The rolls are overwrapped with polymer film 52. FIG. 10B demonstrates that this configuration provides a volume savings of 37% with respect to a conventional four roll package.

Figure 6:
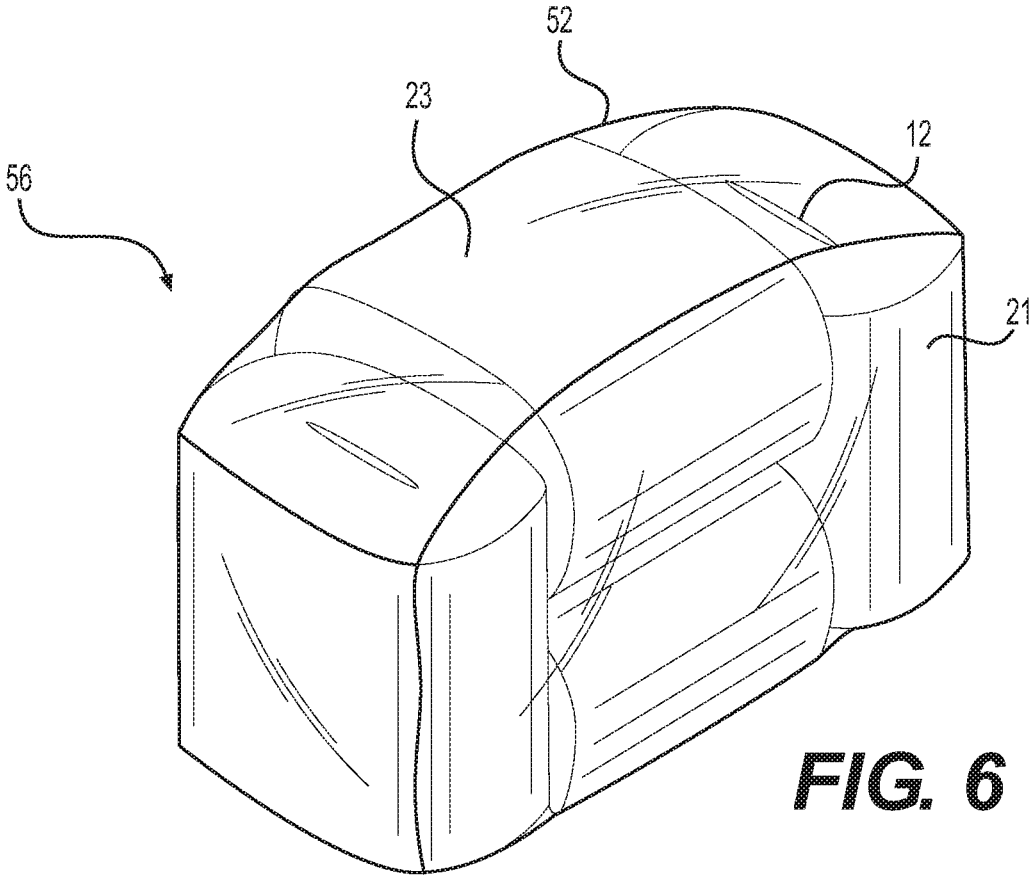
FIG. 6 illustrates a package which contains four compressed rolls, two of which are disposed centrally with their collapsed axial cavities arranged in parallel between two other outer rolls wherein the collapsed axial cavities of the outer rolls are arranged perpendicularly with respect to the collapsed axial cavities of the centrally located compressed rolls.
Figure 10C:
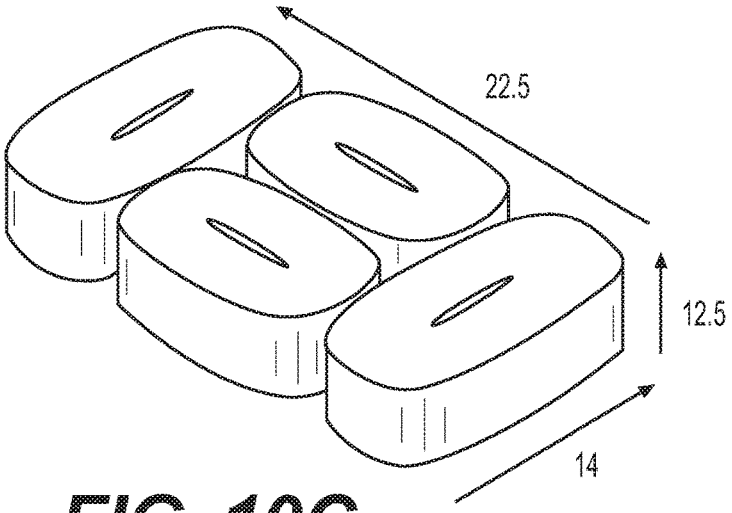

FIG. 6 illustrates a package 56 which contains four compressed rolls 23, two of which are disposed centrally with their collapsed axial cavities (not visible) arranged in parallel between two outer rolls 21, wherein the collapsed axial central cavities 12 of the outer rolls 21 are arranged perpendicularly with respect to the collapsed axial cavities of the centrally located compressed rolls 23. The rolls are overwrapped with polymer film 52. A similar arrangement is shown in FIG. 10C wherein it can be seen the package configuration provides a volume savings of 32% as compared with a conventionally packaged four roll ensemble.

Figure 7:
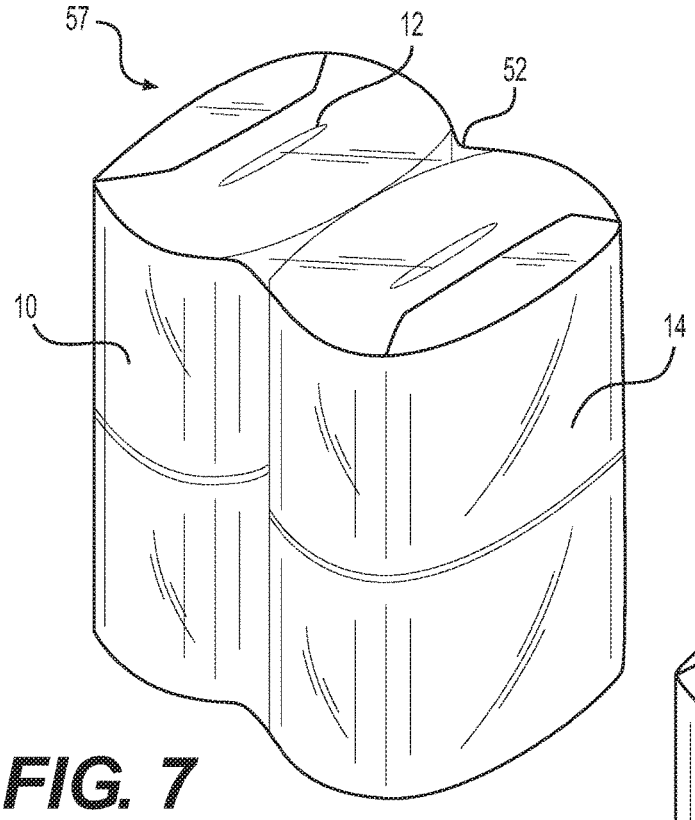
FIG. 7 illustrates a package which contains four compressed rolls disposed in a stacked 2×2 array with the collapsed axial cavities of two pairs of stacked compressed rolls arranged coaxially and wherein the longer side of the compressed rolls arranged in facing relationship to each other.
Figure 10D:
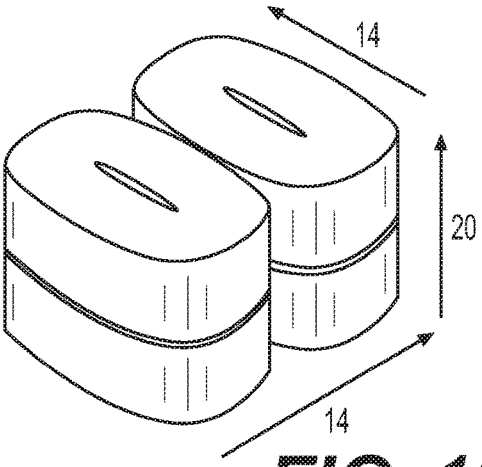
Figure 10E:
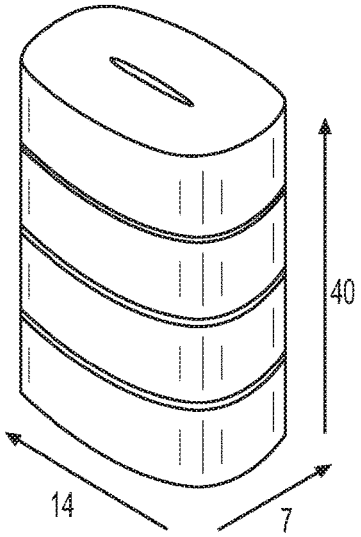
Figure 10F:
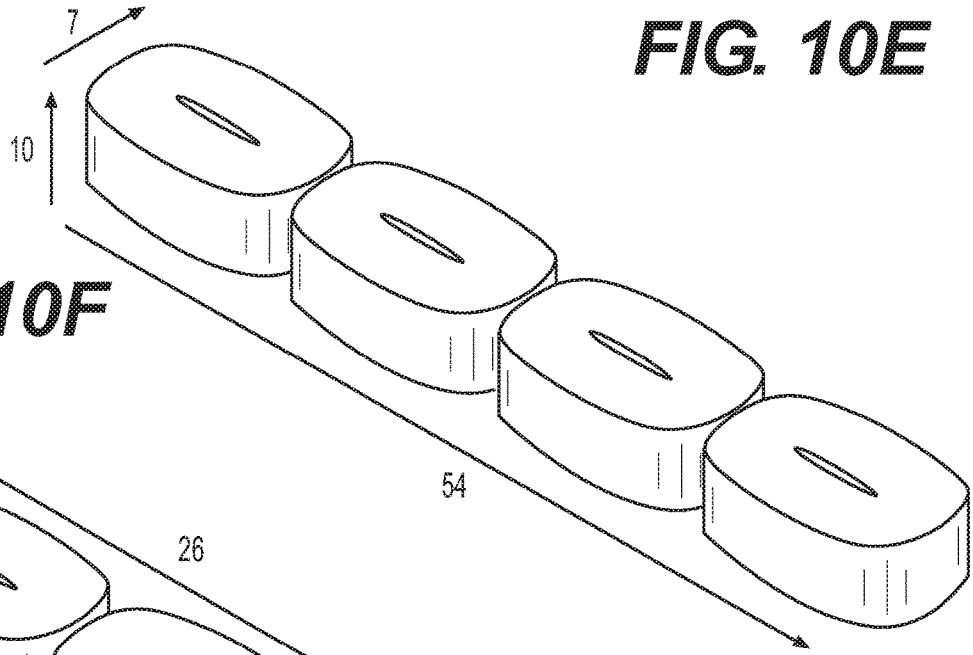

FIG. 7 illustrates a package 57 which contains four compressed hollow coreless rolls 10 disposed in a stacked 2×2 array with the collapsed axial central cavities 12 of two pairs of stacked compressed hollow coreless rolls 10 arranged coaxially and wherein the longer side 14 of the compressed hollow coreless rolls 10 arranged in facing relationship to each other. The rolls are overwrapped with polymer film 52. It is seen in FIG. 10D that this package also provides a volume savings of 32% as compared with conventionally packaged product.

Figure 8:
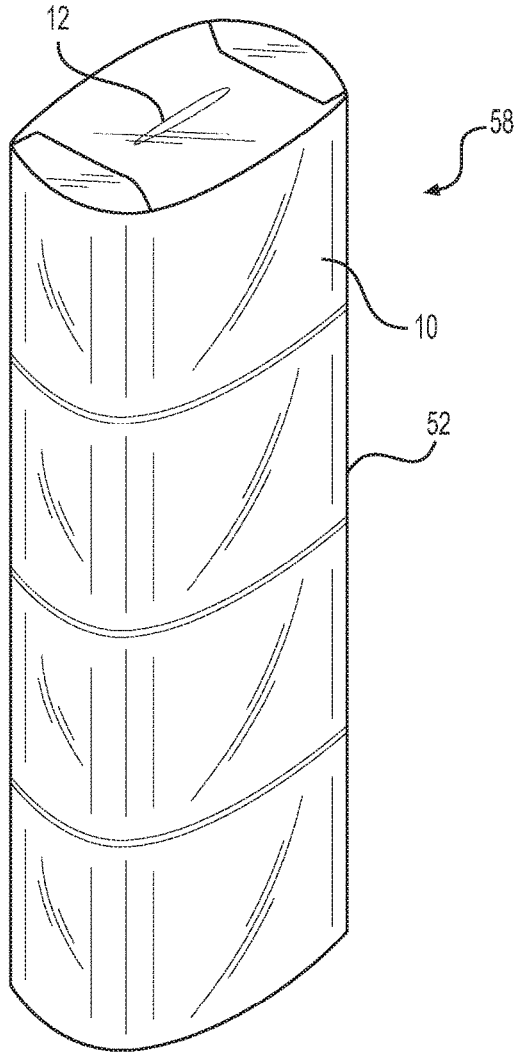
FIG. 8 illustrates a package which contains four rolls disposed in a 1×4 array with the collapsed axial cavities of the compressed rolls coaxially arranged.

FIG. 8 illustrates a package 58 which contains four compressed hollow coreless rolls 10 disposed in a 1×4 array with the collapsed axial central cavities 12 of the compressed hollow coreless rolls 10 coaxially arranged. The rolls are overwrapped with polymer film 52. It can be seen in FIG. 10E that this package likewise provides a 32% volume savings compared with conventionally packaged rolls.

Figure 9:
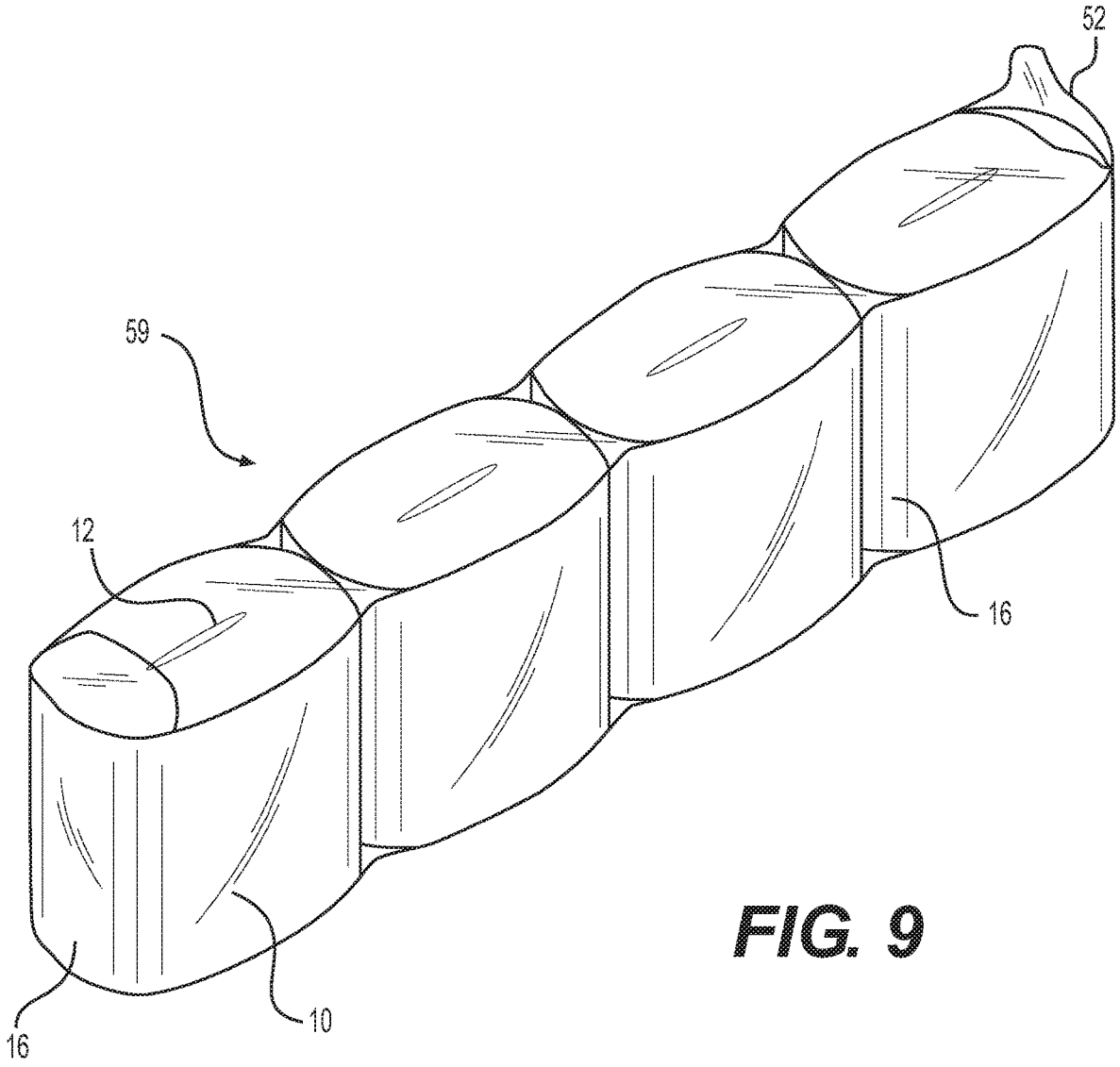
FIG. 9 illustrates a package which contains four rolls disposed in a 1×4 array with the collapsed axial cavities of the compressed rolls arranged in parallel and wherein the shorter sides of the compressed rolls are arranged in facing relationship.

FIG. 9 illustrates a package 59 which contains four compressed hollow coreless rolls 10 disposed in a 1×4 array with collapsed axial central cavities 12 of the compressed hollow coreless rolls 10 arranged in parallel and wherein shorter sides 16 of compressed hollow coreless rolls 10 are arranged in facing relationship. The rolls are overwrapped with polymer film 52. Here, the volume savings is 34% compared with conventional packaging as demonstrated in FIG. 10F.

Figure 10G:
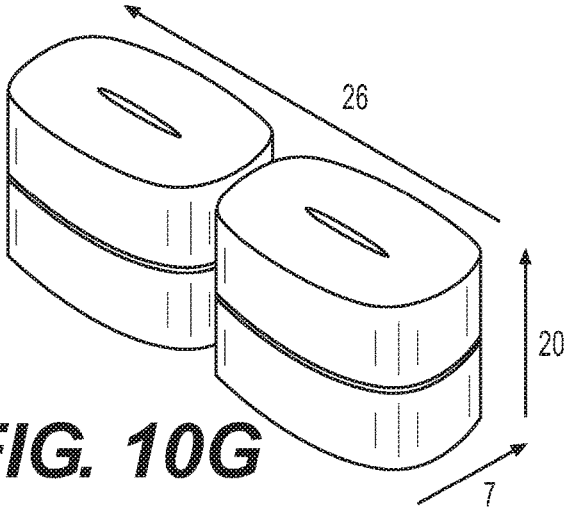
Figure 11A:
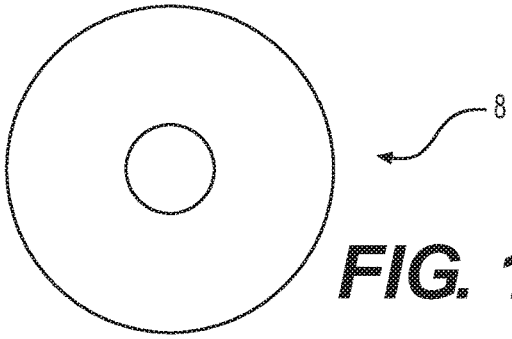
FIGS. 11A through 11D illustrate schematically how a hollow roll of tissue, having its core previously removed, may be uniaxially compressed using opposed pistons producing an elliptical void wherein the long walls of the ellipse are nearly planar and parallel to each other, preferably touching, or nearly so, along most of their length.
Figure 11B:
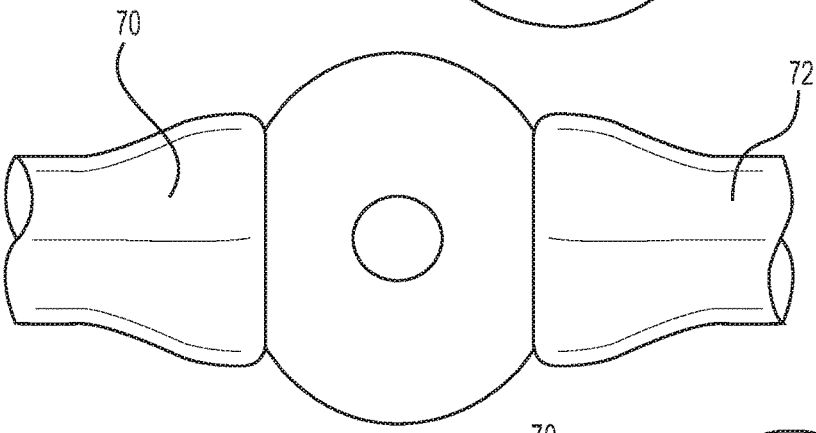
Figure 11C:
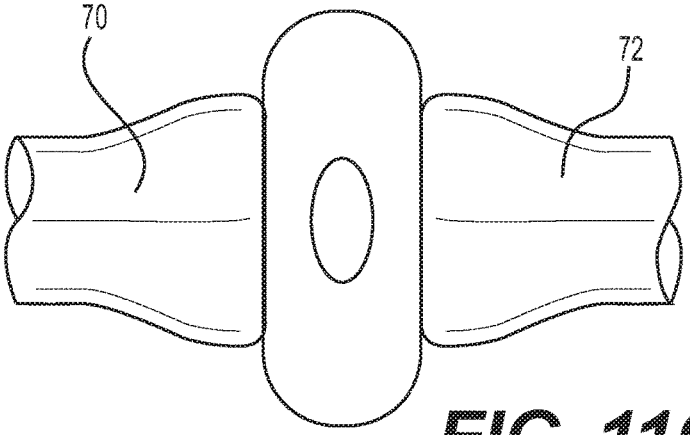
Figure 11D:
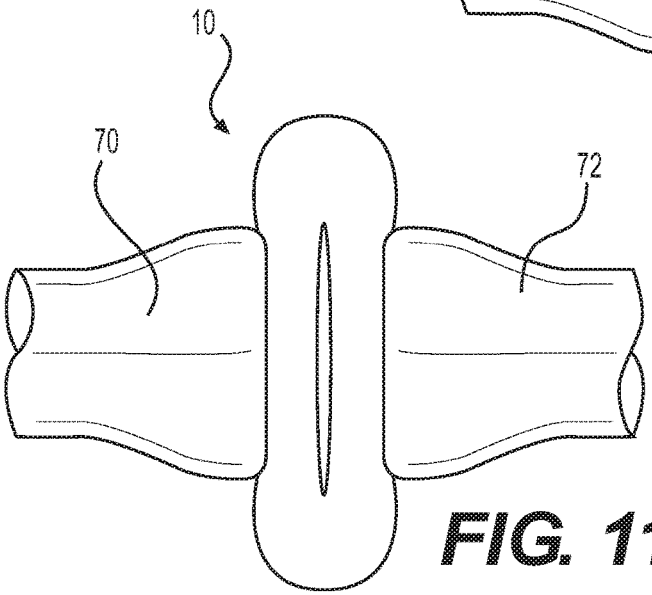

Still yet another package configuration is shown in FIG. 10G wherein a 2×2 stacked array of compressed rolls with collapsed axial cavities of two pairs of stacked rolls arranged coaxially and the shorter sides of the compressed rolls are arranged in facing relationship to each other. Here, again, a 34% volume savings is realized.

Figure 12:
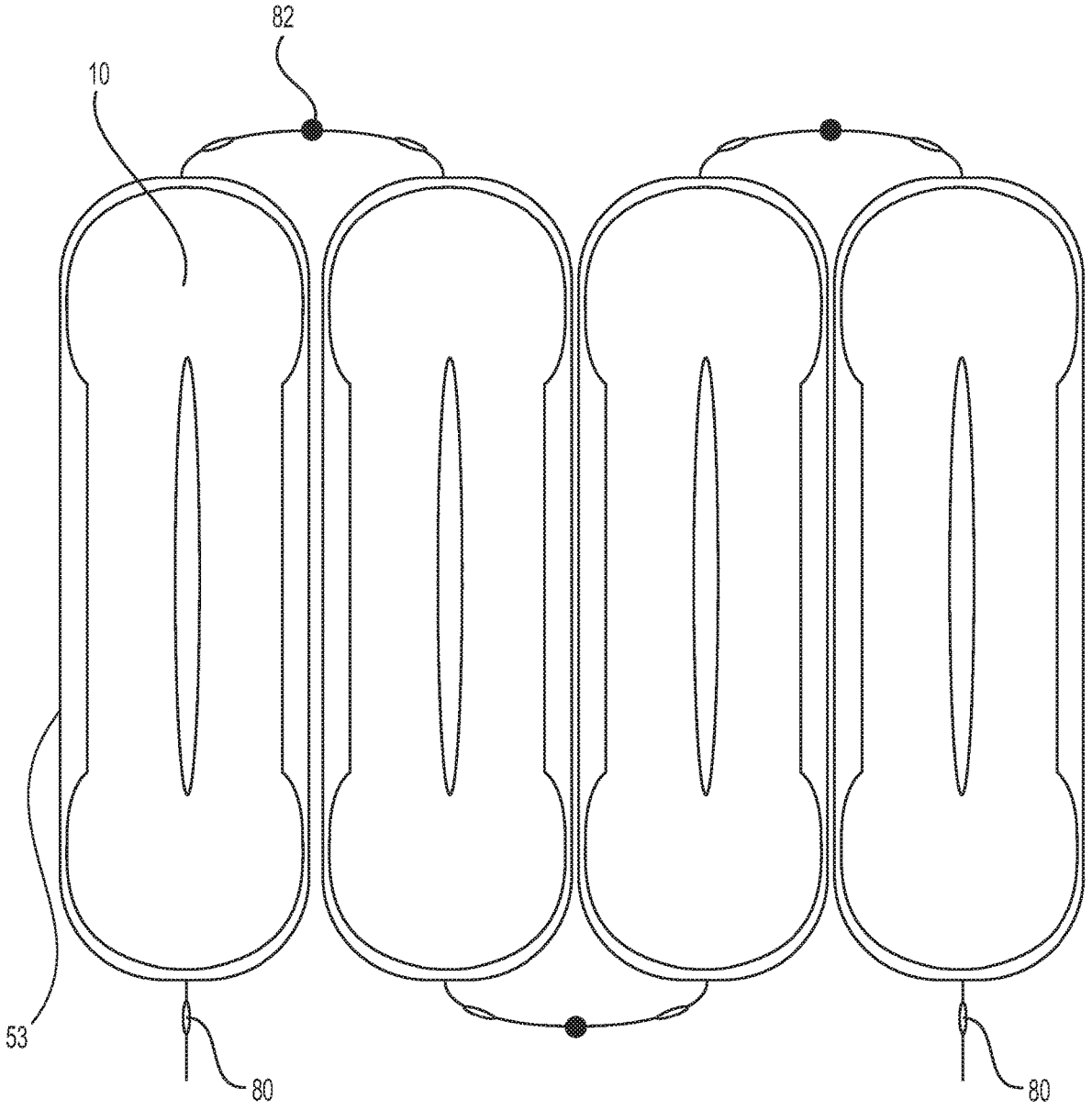
FIG. 12 is a schematic illustration of a four pack of hollow compressed tissue rolls encased in a hollow polymeric tube which has been heat sealed between the hollow compressed rolls to form a flexible pack which can be disposed in a very large number of configurations.

FIG. 12 illustrates four compressed hollow coreless rolls 10 encased in a hollow polymeric tube 53 in which each compressed hollow coreless roll 10 is arrayed side-by-side with the other compressed hollow coreless rolls 10 in a serpentine fashion which allows the user to rearrange the four rolls to fit in a convenient storage spot while retaining the sealed character of the package encasing each individual compressed hollow coreless roll 10. Polymeric tube 53 is heat-sealed just before and just after each compressed hollow coreless roll 10 as indicated by heat sealed regions 80. Thus, if there are four compressed hollow coreless rolls 10 in a particular polymeric tube 53, eight heat sealed regions 80 will be present. In addition, a number of lines of weakness 82 are provided so that each individual compressed hollow coreless roll 10 may be removed from the package while retaining its sealed character. Thus, each individual compressed hollow coreless roll 10 of tissue has disposed one heat seal region 80 at each end of polymeric tube 53. An individual roll may be removed from the package by tearing along a line of weakness 82. It can be seen that the four compressed hollow coreless rolls 10 can be easily arranged in a 2×2 configuration or with all four compressed hollow coreless rolls 10 aligned in a straight line. Conveniently, larger packages can be easily manufactured using four roll packs as building blocks as described hereinafter with the assemblages of four roll packs overwrapped by a polyethylene film.

Figure 13:
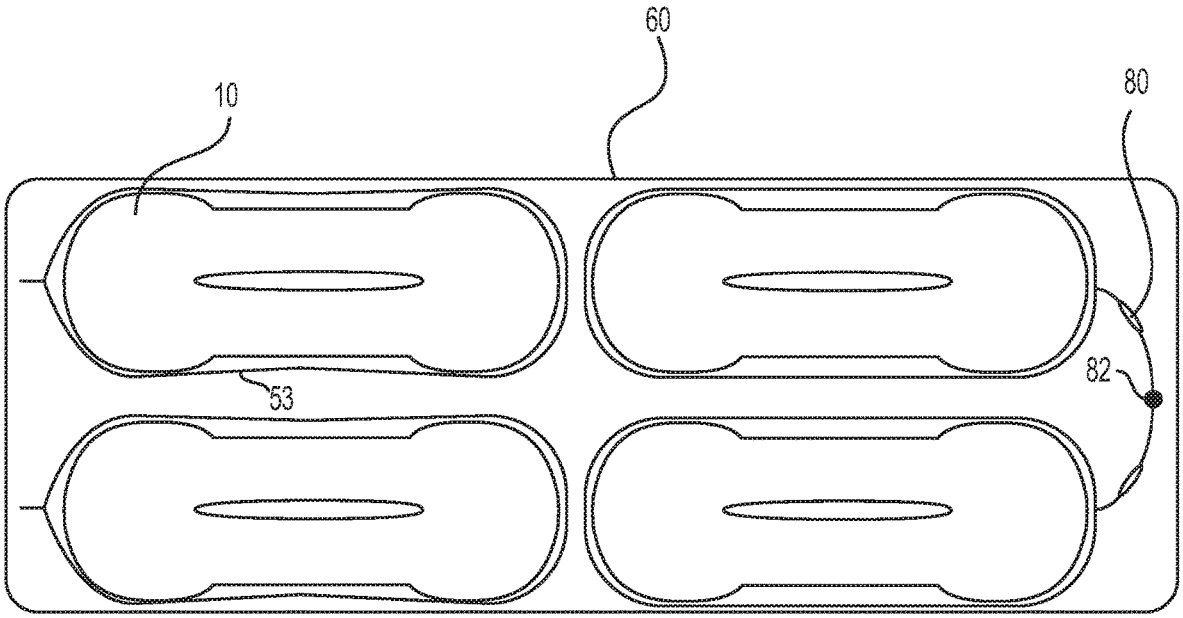
FIG. 13 is another schematic illustration of a four pack of hollow compressed tissue rolls encased in a hollow polymeric tube which has been disposed in another configuration.

FIG. 13 illustrates a similar four roll package 57 comprising four compressed hollow coreless rolls 10 in a serpentine polymeric tube 53. However, heat seal regions 80 are provided only between the interior two compressed hollow coreless rolls 10 of tissue, allowing for a material savings between the first and second and also between the third and fourth rolls in the tube wherein only a line of weakness 82 is interposed. This package may be preferred for retail establishments in the case of four packs as the configuration is relatively stable on the shelf as compared to a stacked four pack in which two rolls of tissue are placed above two other rolls of tissue. For manufacturing convenience, constant spacing between rolls may be preferred.

Figure 14:
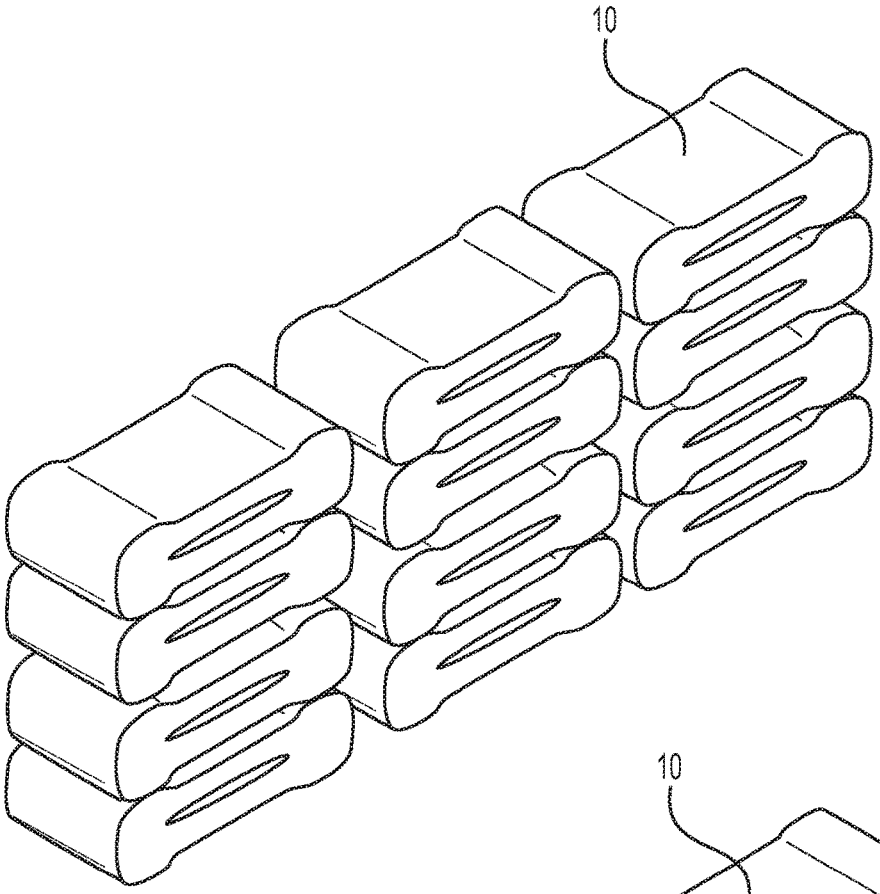
FIG. 14 is another schematic illustration of how three four packs of hollow compressed tissue rolls encased in a hollow polymeric tube may be disposed in an overall configuration forming a twelve pack.
Figure 15:
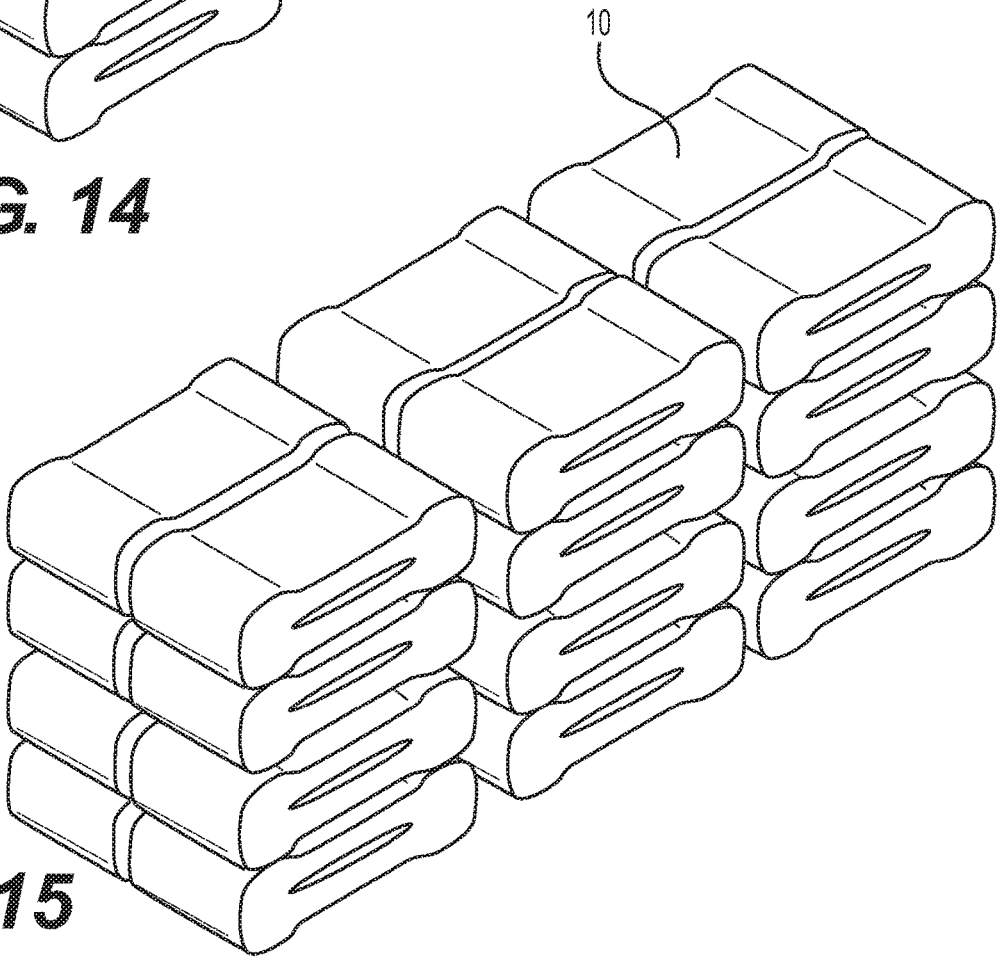
FIG. 15 is another schematic illustration of how six four packs of hollow compressed tissue rolls encased in a hollow polymeric tube may be disposed in an overall configuration forming a twenty-four pack.

FIG. 14 illustrates how a tissue twelve pack of compressed hollow coreless rolls 10 may be easily formed comprising three fours packs as illustrated in FIG. 12. In this case the polymeric overwraps are not shown. FIG. 15 is a twenty-four pack of compressed hollow coreless rolls 10, made up similarly.

Figure 16:
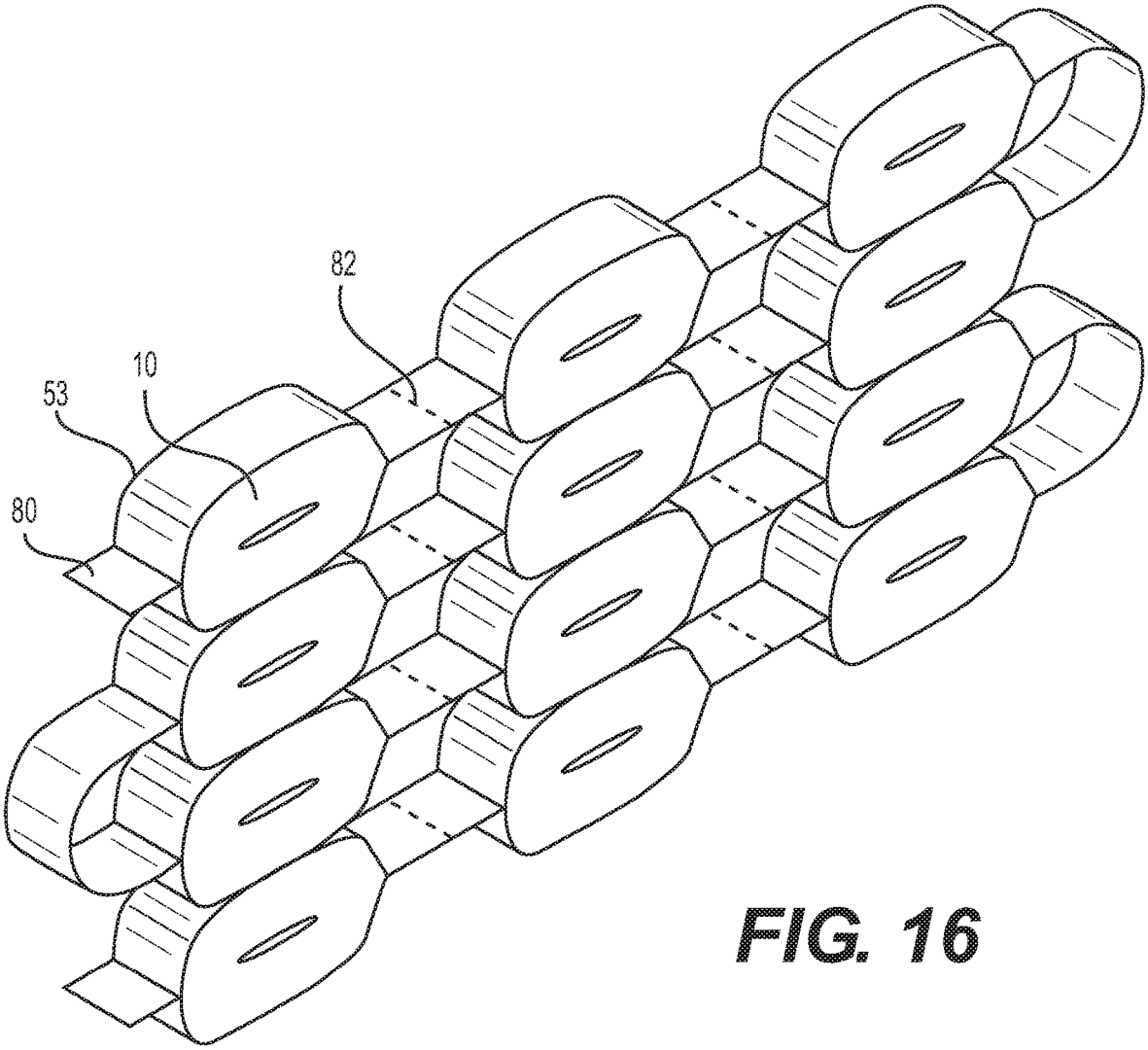
FIG. 16 is a schematic illustration of how twelve hollow compressed rolls of tissue may be disposed in a single elongated polymeric tube to form a flexible package which can be configured in a large number of postures. The length of the portions of the hollow polymeric tube between adjacent rolls has been exaggerated to more clearly show the heat sealed regions and lines of weakness formed in that portion of hollow polymeric tube between rolls.

FIG. 16 illustrates how a very long serpentine pack comprising a total of twelve rolls can be assembled. The length of polymeric tube 53 between each compressed hollow coreless roll 10 is exaggerated to more clearly illustrate how two heat sealed regions 80 and line of weakness 82 are provided between each roll and its neighbor so that a single roll can be removed while maintaining the sealed character and protection from dirt and contamination provided to each other roll in the serpentine pack. In most cases, a polymeric overwrap (not shown) would be provided over the assemblage to stabilize the package for display on a store shelf.

Figure 17:
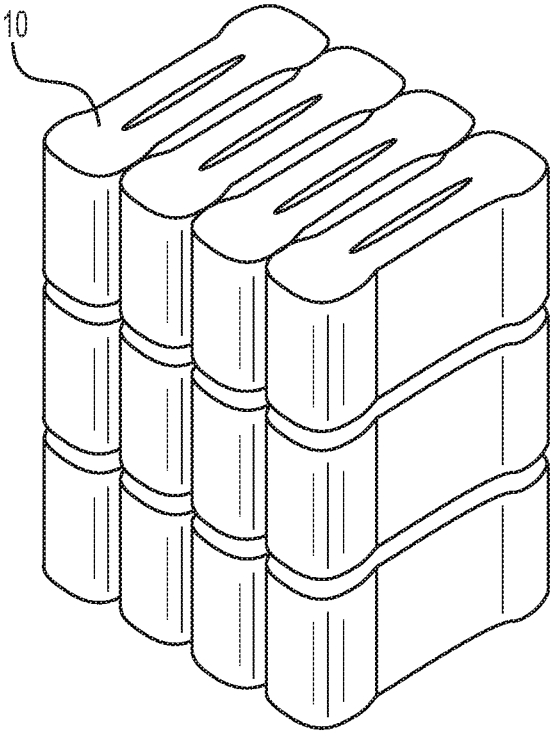
FIG. 17 is another schematic illustration of how three four packs of hollow compressed tissue rolls encased in a hollow polymeric tube may be disposed in an overall configuration forming a twelve pack.
Figure 18:
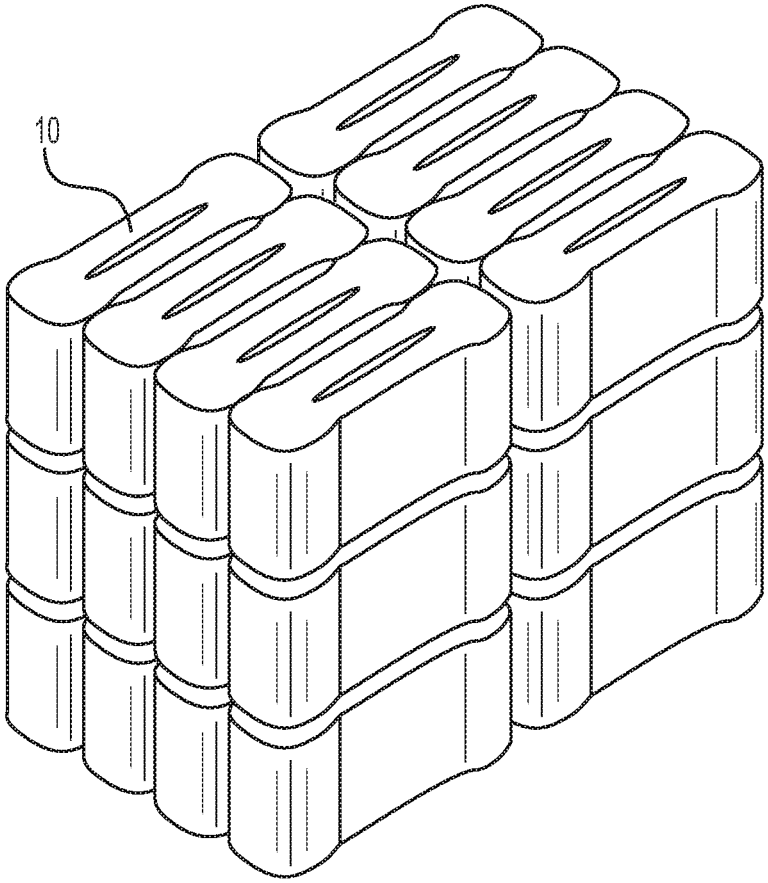
FIG. 18 is another schematic illustration of how six four packs of hollow compressed tissue rolls encased in a hollow polymeric tube may be disposed in another overall configuration forming a twenty-four pack.
Figure 19A:
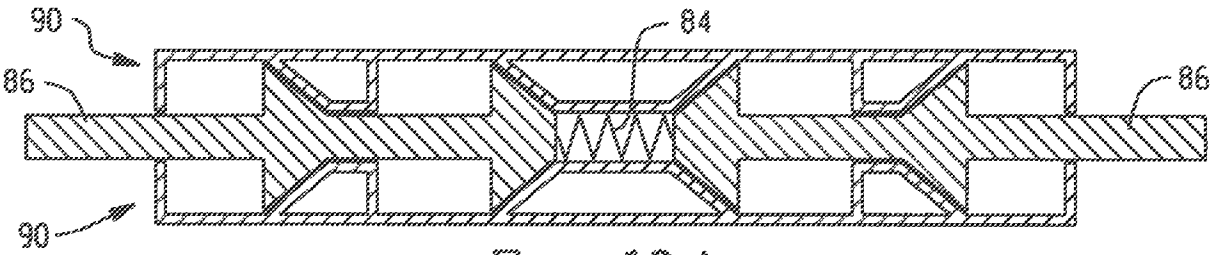
FIGS. 19A through 19F schematically illustrate an expandable spindle suitable for use in a home tissue dispenser which may be inserted into the cavity of hollow compressed tissue rolls to urge them into a more rounded shape.
Figure 19B:
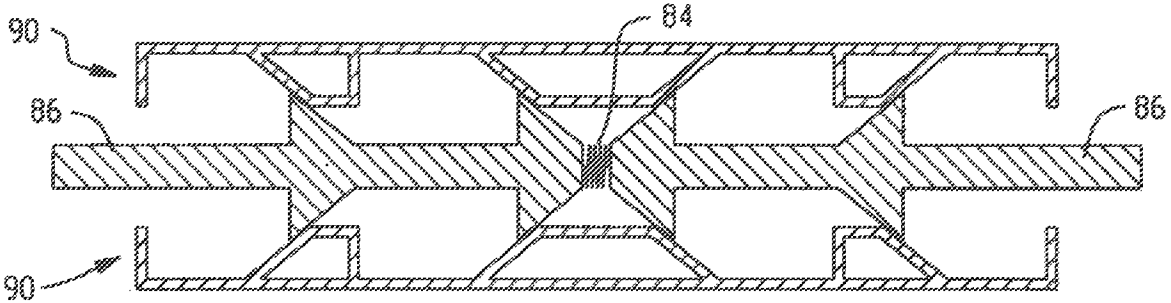
Figure 19F:
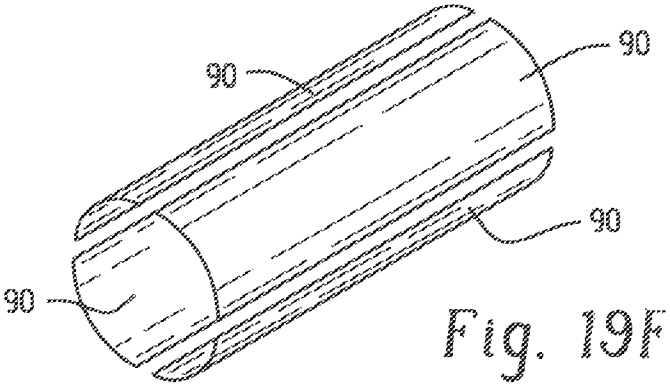
Figure 19E:
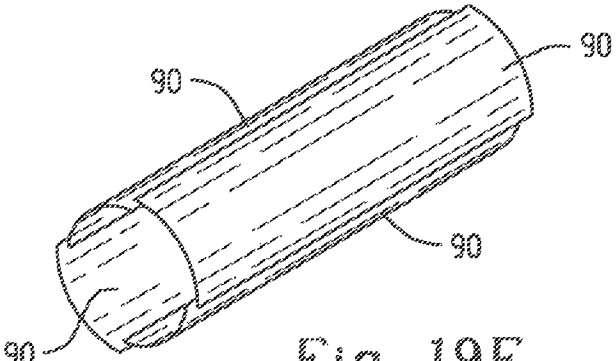
Figure 19C:
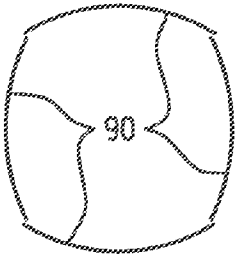
Figure 19D:
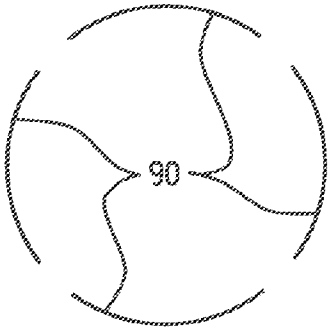
Figure 20A:
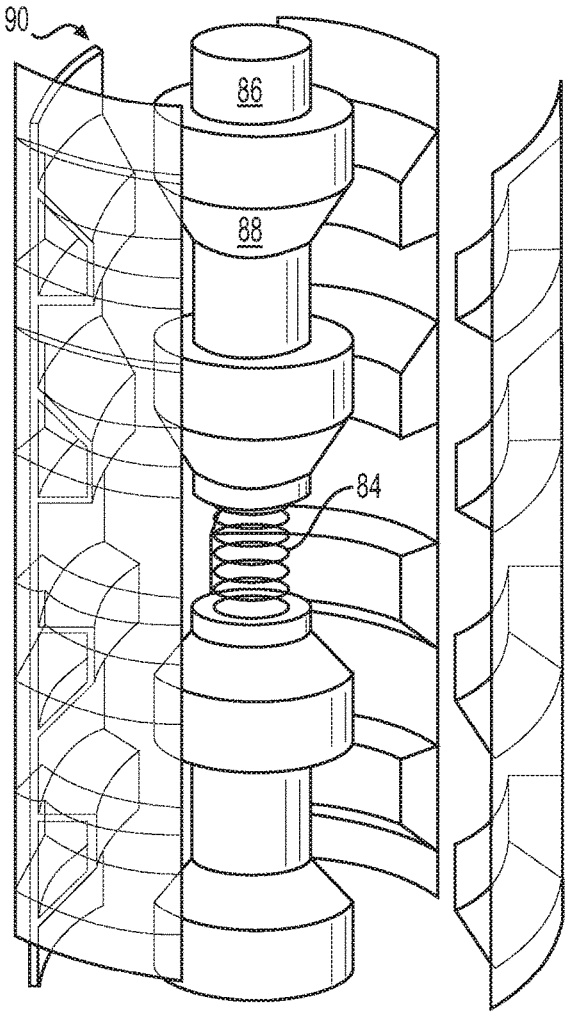
FIGS. 20A through 20D schematically illustrate the interior workings of an expandable spindle suitable for use in a home tissue dispenser which may be inserted into the cavity of hollow compressed bath tissue rolls to urge them into a more rounded shape.
Figure 20B:
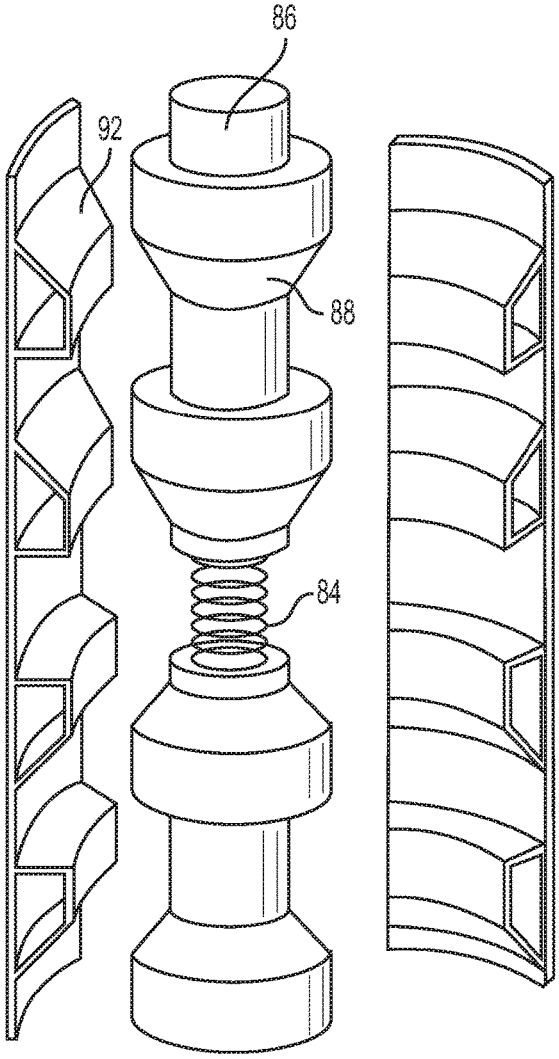
Figure 20C:
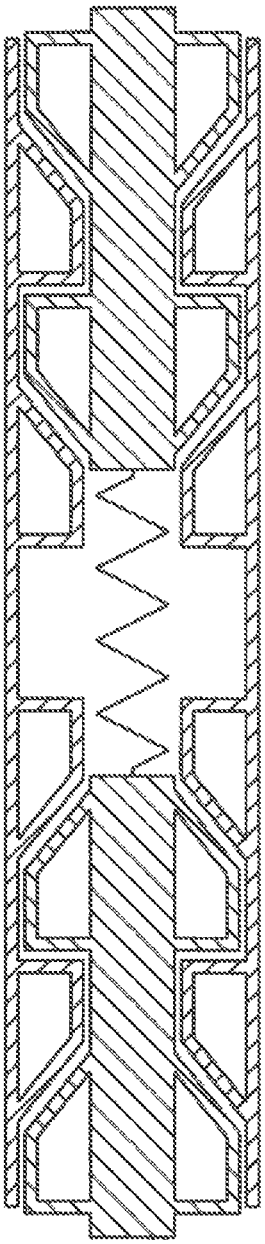
Figure 20D:
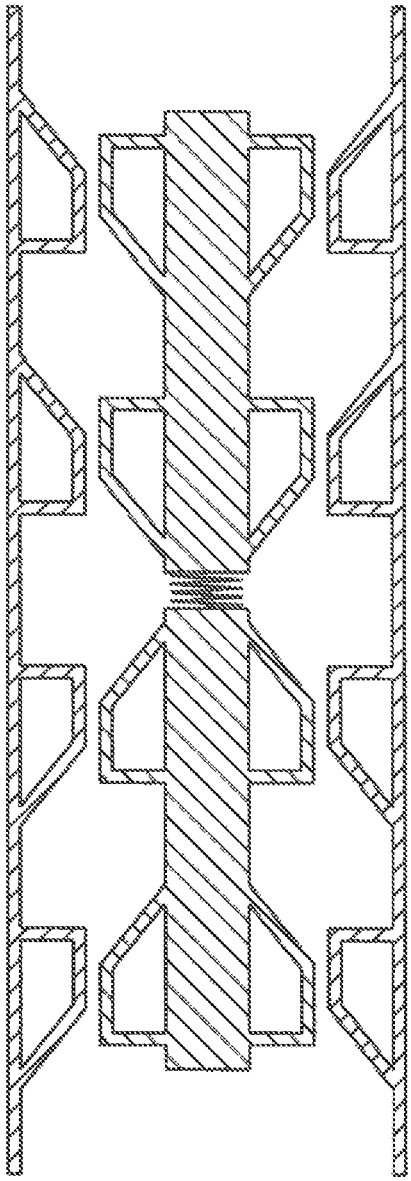

FIG. 17 illustrates another tissue twelve pack of compressed hollow coreless rolls 10 which can be assembled either by stacking four three packs side-by-side or by stacking three of the four packs illustrated in FIG. 12 on top of each other. Similarly, FIG. 18 illustrates a tissue twenty-four pack of compressed hollow coreless roll 10 which can be easily assembled from two of the twelve packs of FIG. 17.

FIGS. 19A through 19F and 20A through 20D illustrate an expandable spindle which may be used with the hollow compressed tissue rolls of the present invention to restore the compressed tissue roll to a generally cylindrical configuration. In the spindles, frustoconical surfaces 88 are mounted upon shafts 86 which are urged apart by spring 84. Leaf segments 90 having mating frustoconical surfaces 92 formed therein are forced outwardly when the two shafts 86 are forced together to insert the tissue roll thereabout into a conventional holder.

Figure 21A:
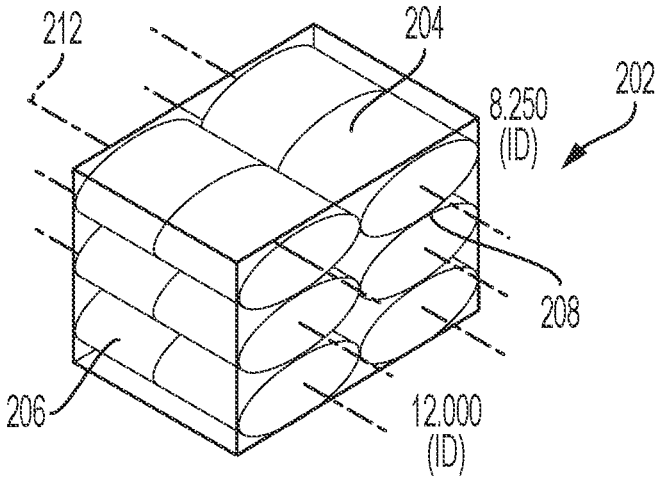
FIGS. 21A through 21C schematically illustrate a packing scheme in which poly-wrapped 12 packs of compressed bath tissue are palletized without cartons yielding a particularly efficient truckload of tissue.
Figure 21B:
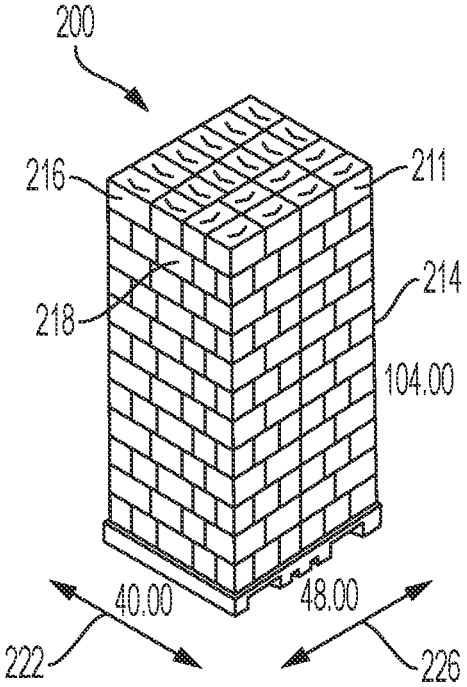
Figure 21C:
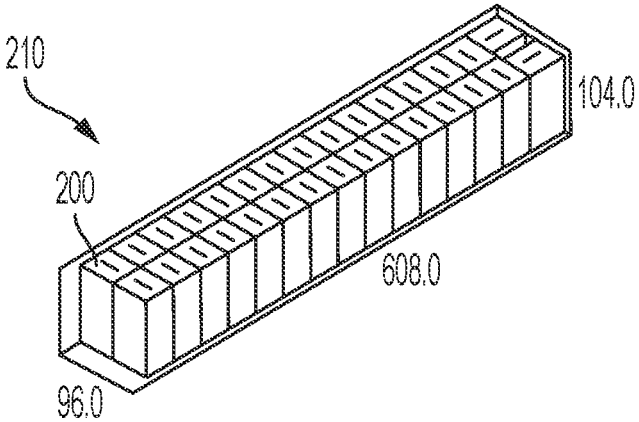
Figure 22A:
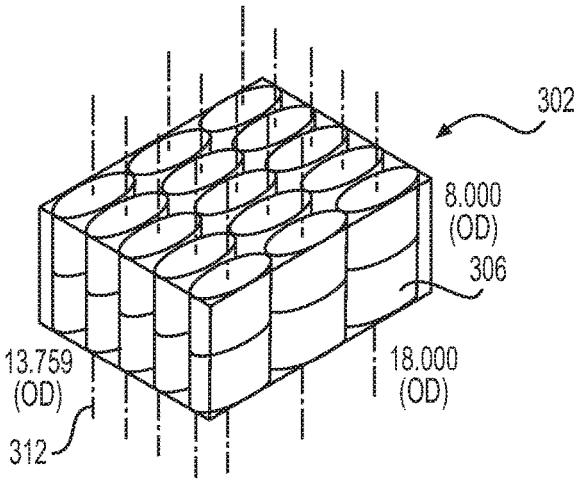
FIGS. 22A through 22E schematically illustrate a packing scheme in which poly-wrapped 30 packs of compressed bath tissue are packed 3 to a carton and palletized yielding a particularly efficient truckload of tissue.
Figure 22B:
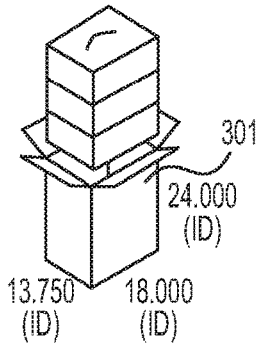
Figure 22C:
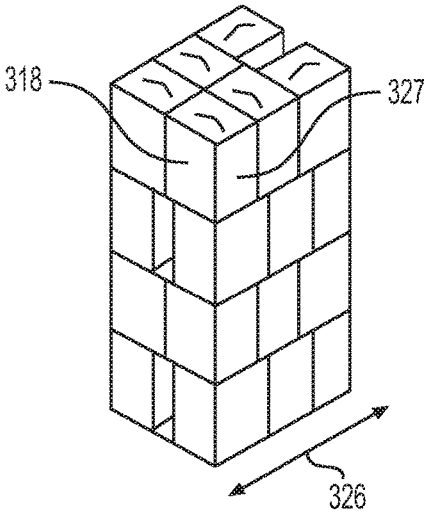
Figure 22D:
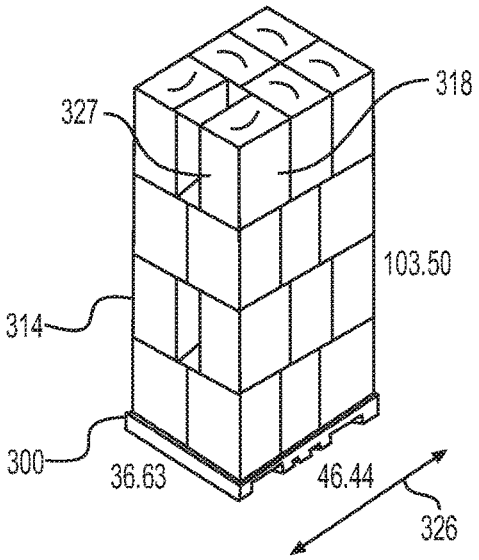
Figure 22E:
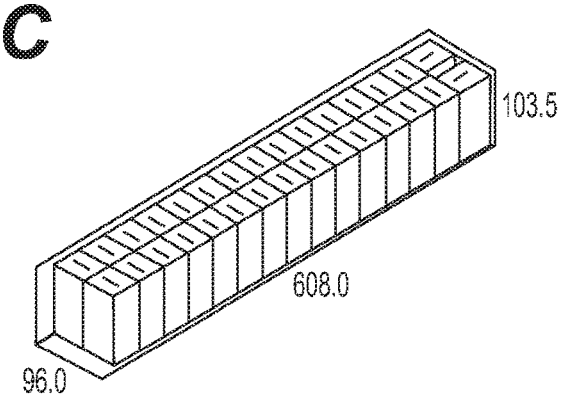
Figure 23A:
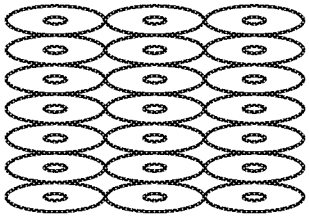
FIGS. 23A through 23H schematically illustrate a variety of configurations of poly-wrapped bath tissue rolls particularly suitable for e-commerce.
Figure 23B:
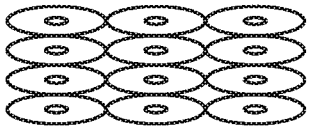
Figure 23C:
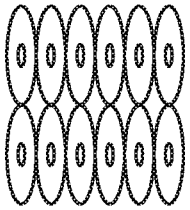
Figure 23D:
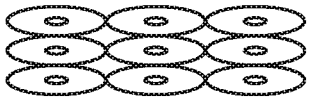
Figure 23E:
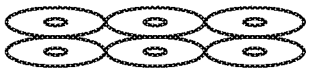
Figure 23F:
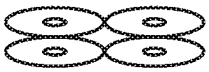
Figure 23G:
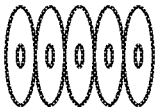
Figure 23H:
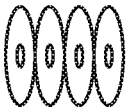

FIGS. 21A through 21C illustrate one particularly advantageous method of packing compressed hollow coreless re-formable roll products of the present invention on pallets 200 poly packs 202, preferably poly-wrap 12 pack tissue ensembles. Each poly pack 202 has 4 columns 204 of rolls 206 in a 2×2 array of 3 rolls 206 with each roll 206 lying on its longer side 208 as shown in FIG. 21A with 2 other similarly oriented rolls 206 in the same column 204. Poly packs 202 are palletized as shown in FIG. 21B and fitted into standard trailer 210 as shown in FIG. 21C. Axis 212 of each roll 206 in poly pack 202 is parallel to axis 212 of every other roll 206 in poly pack 202 and axis 212 of each roll 206 is collinear with axis 212 of one other roll 206. Poly-packs 202 are palletized in 12 layers 214 wherein each layer 214 comprises 2 rows 216 of 6 poly packs 202 with long side 218 of each poly pack 202 being parallel to shorter axis 222 of pallet 200 and 2 rows 211 of 4 poly packs 202 wherein long side 218 of each poly pack 202 is parallel to long axis 226 of pallet 200 and wherein each layer 214 is arrayed similarly but rotated 180° relative to layers 214 immediately above and below it. Pallet 200 with 12 layers 214 of (poly wrapped tissue packs) poly packs 202 is shrink-wrapped in another layer (not illustrated) of polyethylene, desirably of a sufficiently heavier gauge polyethylene to provide for a pallet having dimensional stability and sufficient durability to survive commercial transportation practices. In figures in this application, where dimensions appear alongside a figure, it is to be understood that those are linear dimensions in inches. When the trailer is loaded, it will often be convenient to turn two of the pallets 200 with their long directions parallel to the length of the trailer. Although this is not required to obtain the benefits of the invention, it can help restrict longitudinal movement of pallets 200.

Table 1 sets forth the relevant parameters concerning the shipping efficiency of this configuration. It is considered particularly significant that the cubic efficiency of this packaging configuration is almost 85%.

TABLE 1

| 53 ft Trailer 636.0 × 101.0 × 110.0 | | | | |
|---|---|---|---|---|
| | Bottle (OD) | Shipper (OD) | Unit Load (Incl. Pal) | Vehicle Load |
| Ln: | 6.000 in | 12.000 in | 48.00 in | 608.00 in |
| Wd: | 2.750 in | 8.000 in | 40.00 in | 96.0 in |
| Ht: | 4.000 in | 8.250 in | 104.00 in | 104.0 in |
| Net: | 0.00 oz | 0.00 lb | 0.00 lb | 0.00 lb |
| Grs: | 0.00 oz | 0.45 lb | 153.33 lb | 4600.00 lb |
| Cube: | 51.815 $in^3$ | 0.458 $ft^3$ | 115.556 $ft^3$ | 3512.889 $ft^3$ |
| | Width Vert | Height Vert | | |
| Bottle: | | 12 | 2880 | 86400 |
| Shipper: | | | 240 | 7200 |
| Unit Loads: | | | | 30 |
| Area Efficiency: | | 100.00% | 100.00% | 87.67% |
| Cubic Efficiency: | | 78.51% | 99.00% | 84.78% |
| Cases per layer: | | | 20 | 7200 |
| UL per layer: | | | | 30 |
| Layers/load: | | | 12 | 1 |
| Pattern | | :2 × 2 × 3 | Interlock | Interlock |
| Density (gr/cc): | | 0.0158 | | 0.0150 |

FIGS. 22A through 22E illustrate a packaging configuration in which pallets 300 carry cartons 301 cartons in layers 314, in which each carton 301 contains 3 poly wrap packs 302 of 30 compressed hollow coreless re-formable rolls 306 of the present invention. Each poly wrap pack 302 comprises 15 columns 304 of rolls 306 in a 5×3 array of 2 rolls 306 with long side of each roll 306 aligned with the 3 deep dimension of the array. Each carton 301, which may be corrugated, contains 3 poly wrap packs 302 in a vertical array with axis 312 of each roll 306 being vertical. Each layer 314 comprises 4 cartons 301 in a 2×2 array with long side 318 of each carton being normal to long axis 326 of pallet 300 and 2 cartons 301 having long side 318 parallel to long axis 326 of pallet 300, these 2 cartons 301 being spaced apart from each other, each having one long side 318 generally coplanar with exterior short sides 327 of the two cartons 301 on each side in the same layer 314 therewith as well as coplanar with exterior short sides 327 of the two cartons 301 in a layer 314 immediately thereabove or therebelow. When the trailer is loaded, it will often be convenient to turn two of the pallets 300 with their long directions parallel to the length of the trailer. Although this is not required to obtain the benefits of the invention, it can help restrict longitudinal movement of pallets 300.

Table 2 sets forth the relevant parameters concerning the shipping efficiency of this configuration. It is considered particularly significant that the cubic efficiency of this packaging configuration is again almost 85%.

TABLE 2

| 53 ft Trailer 636.0 × 101.0 × 110.0 | | | | | | | | |
|---|---|---|---|---|---|---|---|---|
| | Battle (OD) | Carton (OD) | Shipper (ID) | Shipper (OD) | Shipper Slack | Shipper Bulge | Unit load (Incl. Pal) | Vehicle Load |
| Ln:: | 6.000 in | 18.000 in | 18.000 in | 18.313 in | 0.000 in | 0.000 in | 46.44 in | 608.00 in |
| Wd: | 2.750 in | 13.750 in | 13.750 in | 14.063 in | 0.000 in | 0.000 in | 36.63 in | 96.0 in |
| Ht: | 4.000 in | 8.000 in | 24.000 in | 24.625 in | 0.000 in | 0.000 in | 103.50 in | 103.5 in |
| Net: | 0.000 oz | 0.00 lb | | 0.00 lb | | | 0.00 lb | 0.00 lb |
| Grs: | 0.00 oz | 0.77 lb | | 4.04 lb | | | 142.00 lb | 4259.86 lb |
| Cube | 51.815 $in^3$ | 1980.000 $in^3$ | 3.438 $ft^3$ | 3.670 $ft^3$ | | | 101.869 $ft^3$ | 3496.000 $ft^3$ |
| | Height Vert | Height Vert | | Height Vert | | | | |
| Unit Loads: | | | | | | | | 30 |
| Area Efficiency: | | | | 100.00% | | | 80.47% | 89.67% |
| Cubic Efficiency: | | | | 100.00% | | | 79.27% | 84.37% |
| UL per layer | | | | | | | | 30 |

Recent years have seen retail marketing move from 'brick-and-mortar stores" to e-commerce with more and more products becoming available on-line for shipment direct to the customer's home or office every day. In the past e-commerce was largely limited to small, compact relatively high value items; but as this channel of commerce is developed, merchandisers have found ways to economically offer more and more products. Towel and tissue products however present unusual difficulties for e-commerce in that their volume to cost ratio is rather lower than the more conventional products. We have found that these compressed hollow coreless re-formable roll products provided much more attractive product for e-commerce due to their greatly reduced volume. Tables 3 and 4 set forth configurations of products which are particularly suitable for e-commerce illustrating the reduction in volume for each configuration tabulated.

For e-commerce applications, it is particularly important to have electronically sortable unit size package to control cost of handling. One particularly common unit size package is 18"×14"×8". Table 3 sets forth the length, width and height for a number of product configurations which are well-suited for this size. It should be noted that each configuration provides a volume savings of at least 22% while the 3 roll by 7 roll by 2 roll configuration using regular length rolls provides a savings of 29%. In Table 3, the "Roll Orientation" column refers to FIGS. 23 A through 23H, the figures illustrating how each roll is arrayed relative to the others. In Tables 3 and 4, a double roll has twice the length of a regular roll while a giant or jumbo roll has a length which is 2.2 or 2.3 times that of a single roll, respectively.

TABLE 3

| Retail Bath Tissue (Sortable Unit Size 18" × 14" × 8") | | | | | | | | |
|---|---|---|---|---|---|---|---|---|
| Product Description | Roll Arrangement in Pack (L × W × H) | Length (in) | Width (in) | Height (in) | Volume (in3) | Roll Orientation | Volume of Cored, Non Compressed in Same Orientation ($in^3$) | Percent Space Savings vs. Cored, Non Compressed in same orientation |
| Regular Roll (EQ = 1) | 3 × 7 × 2 rolls | 15 | 14 | 8 | 1680 | 23A | 2363 | 29 |
| Double Roll (EQ = 2) | 3 × 5 × 2 rolls | 18 | 14 | 8 | 2016 | 23B | 2595 | 22 |
| Giant/Jumbo Roll (EQ = 2.2/2.3) | 5 × 2 × 2 rolls | 18 | 12.5 | 8 | 1800 | 23C | 2305 | 22 |

Table 4 sets forth a number of other product configurations for kitchen roll tell (paper towel) which are also suitable for use in this unit size package. It is particularly important to note that most of these configurations provide a savings of over 30% in volume compared to conventional kitchen roll towel.

TABLE 4

| Retail Paper Towel | | | | | | | | |
|---|---|---|---|---|---|---|---|---|
| Product Description | Roll Arrangement in Pack (L × W × H) | Length (in) | Width (in) | Height (in) | Volume ($in^3$) | Roll Orientation | Volume of Cored, Non Compressed in Same Orientation ($in^3$) | Percent Space Savings vs. Cored, Non Compressed in same orientation |
| Regular Roll (EQ = 1.0) | 3 × 3 × 1 roll | 15 | 2.5 | 11 | 1238 | 23D | 2005 | 38 |
| Big Roll (EQ = 1.33) | 3 × 2 × 1 roll | 18 | 6.5 | 11 | 1287 | 23E | 1925 | 33 |
| Giant Roll (EQ = 1.5) | 2 × 2 × 1 roll | 13 | 6.5 | 11 | 930 | 23F | 1430 | 35 |
| Giant Roll (EQ = 1.5) | 5 × 1 × 1 roll | 16.25 | 6.5 | 11 | 1162 | 23G | 1787 | 35 |
| XL Roll (EQ = 2.0) | 2 × 2 × 1 roll | 13.25 | 8.8 | 11 | 1283 | 23F | 1584 | 19 |
| XL Roll (EQ = 2.0) | 4 × 1 × 1 roll | 17.67 | 6.625 | 11 | 1288 | 23H | 1980 | 35 |

Table 5 presents the possible savings and efficiency of trailer volume utilization achievable with other product configurations of compressed hollow coreless re-formable roll products of the present invention.

TABLE 5

| Coreless Compressed Quilted Northern Ultra Plush ® Double Roll Truck Load Efficiencies | | | | |
|---|---|---|---|---|
| Pack Configuration | Number of Rolls per Pack | Secondary Packaging | Number of Rolls per Truck | Percent Increase from Un-compressed |
| Brick - 2 × 3 roll in two layers | 12 | 4 packs per case | 62,208 | Un-compressed w/core |
| Brick - 2 × 3 roll in two layers | 12 | 4 packs per case | 69,120 | 11 |
| Brick on Side - 2 × 3 roll in two layers | 12 | 4 packs per case | 71,280 | 15 |
| Brick - 2 × 3 roll in two layers | 12 | none | 77,760 | 25 |
| Brick on Side - 2 × 3 roll in two layers | 12 | none | 86,400 | 39 |
| Brick - 3 × 5 rolls in two layers | 30 | none | 54,000 | Un-compressed w/core |
| Brick - 3 × 5 rolls in two layers | 30 | none | 64,800 | 20 |
| Brick - 2 × 5 rolls in three layers | 30 | none | 79,200 | 47 |

TABLE 5-continued

| Coreless Compressed Quilted Northern Ultra Plush ® Double Roll Truck Load Efficiencies | | | | |
|---|---|---|---|---|
| Pack Configuration | Number of Rolls per Pack | Secondary Packaging | Number of Rolls per Truck | Percent Increase from Un-compressed |
| Brick - 3 × 5 rolls in two layers | 30 | 3 packs per case | 54,000 | Un-compressed w/core |
| Brick - 3 × 5 rolls in two layers | 30 | 3 packs per case | 64,800 | 20 |

TABLE 6

| Coreless Compressed Big Roll Truck Load Efficiencies | | | | |
|---|---|---|---|---|
| Pack Configuration | Number of Rolls per Pack | Secondary Packaging | Number of Rolls per Truck | Percent Increase From Current |
| Brick - 2 × 3 rolls in one layer** | 6 | 4 packs per case | 17,280 | current |
| Brick - 2 × 3 rolls in one layer | 6 | 2 packs per case | 20,160 | 17 |
| Brick on Side - 2 × 3 roll in one layer | 6 | 2 packs per case | 22,680 | 31 |

**product with core, non-compressed

TABLE 7

| 53 ft Trailer 636.0 × 101.0 × 110.0 | | | | | | | | |
|---|---|---|---|---|---|---|---|---|
| | Battle (OD) | Carton (ID) | Shipper (ID) | Shipper (OD) | Shipper Slack | Shipper Bulge | Unit Load (Incl. Pal) | Vehicle Load |
| Ln: | 6.000 in | 18.000 in | 18.000 in | 18.313 in | 0.000 in | 0.000 in | 47.94 in | 621.13 in |
| Wd: | 3.250 in | 11.000 in | 11.000 in | 11.313 in | 0.000 in | 0.000 in | 40.94 in | 96.0 in |
| Ht: | 11.000 in | 6.500 in | 13.000 in | 13.625 in | 0.000 in | 0.000 in | 100.38 in | 100.4 in |
| Net: | 0.00 oz | 0.00 lb | | 0.00 lb | | | 0.00 lb | 0.00 lb |
| Grs: | 0.00 oz | 0.56 lb | | 2.15 lb | | | 180.69 lb | 5420.78 lb |
| Cube: | 168.442 $in^3$ | 1287.000 $in^3$ | 1.490 $ft^3$ | 1.633 $ft^3$ | | | 113.993 $ft^3$ | 3463.635 $ft^3$ |
| | Width Vert | Height Vert | | Height Vert | | | | |

TABLE 7-continued

| 53 ft Trailer 636.0 × 101.0 × 110.0 | | | | | | | | |
|---|---|---|---|---|---|---|---|---|
| | Battle (OD) | Carton (ID) | Shipper (ID) | Shipper (OD) | Shipper Slack | Shipper Bulge | Unit Load (Incl. Pal) | Vehicle Load |
| Unit Loads | | | | | | | | 30 |
| Area Efficiency: | | | | 100.0% | | | 97.1% | 91.8% |
| Cubic Efficiency: | | | | 100.0% | | | 92.6% | 83.7% |
| UL per layer: | | | | | | | | 30 |

TABLE 8

| 53 ft Trailer 636.0 × 101.0 × 110.0 | | | | | | | | |
|---|---|---|---|---|---|---|---|---|
| | Battle (OD) | Carton (OD) | Shipper (ID) | Shipper (OD) | Shipper Slack | Shipper Bulge | Unit Load (Incl. Pal) | Vehicle Load |
| Ln: | 6.000 in | 18.000 in | 18.000 in | 18.313 in | 0.000 in | 0.000 in | 44.94 in | 608.00 in |
| Wd: | 3.250 in | 6.500 in | 13.000 in | 13.313 in | 0.000 in | 0.000 in | 39.94 in | 96.0 in |
| Ht: | 11.000 in | 11.000 in | 11.000 in | 11.625 in | 0.000 in | 0.000 in | 98.00 in | 98.0 in |
| Net: | 0.00 oz | 0.00 lb | | 0.00 lb | | | 0.00 lb | 0.00 lb |
| Grs: | 0.00 oz | 0.48 lb | | 2.05 lb | | | 159.69 lb | 4790.85 lb |
| Cube: | 168.442 $in^3$ Height Vert | 1287.000 $in^3$ Height Vert | 1.490 $ft^3$ | 1.640 $ft^3$ Height Vert | | | 101.782 $ft^3$ | 3310.222 $ft^3$ |
| Unit Loads: | | | | | | | | 30 |
| Area Efficiency: | | | | 100.0% | | | 89.9% | 89.7% |
| Cubic Efficiency: | | | | 100.0% | | | 82.7% | 79.9% |
| UL per layer: | | | | | | | | 30 |

Figure 24A:
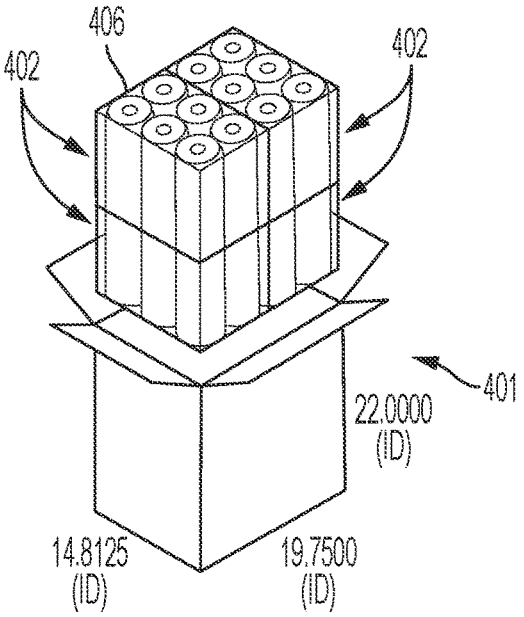
FIG. 24A PRIOR ART
FIGS. 24A through 24C schematically illustrate a Prior Art packing scheme in which poly-wrapped 24 roll packs of cored un-compressed kitchen roll toweling are palletized in cartons.
Figure 24B:
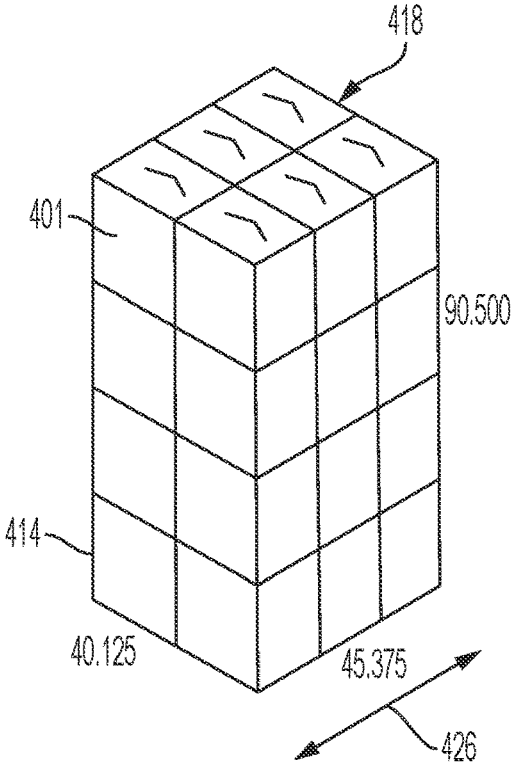
FIG. 24B PRIOR ART
Figure 24C:
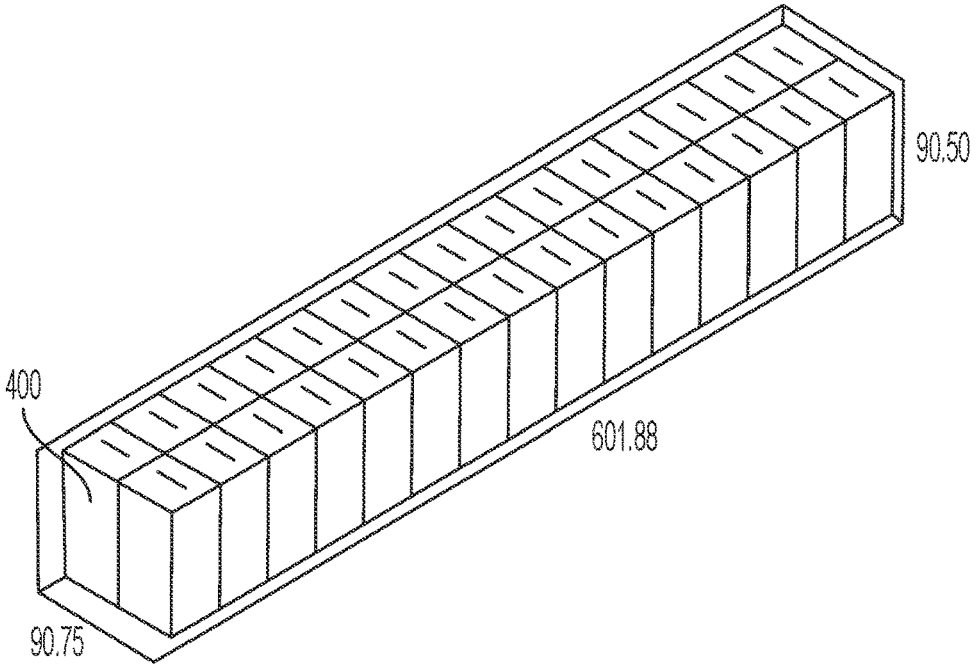
FIG. 24C PRIOR ART

FIGS. 24A-C illustrate a prior art packaging configuration in which pallet 400 cartons 401, preferably carry cartons, in layers 414, in which each carton 401 contains 4 poly wrap packs of conventional uncompressed kitchen roll towel products 406. Each poly wrap pack 402 comprises 6 rolls 406 in a 2×3 array. Each corrugate container 401 contains 4 poly wrap packs 402 in a horizontal array with axis 412 of each roll 406 being vertical. Each layer 414 comprises 6 cartons 406 in a 3×2 array with long side 418 of each carton being normal to long axis 426 of pallet 400.

Figure 25A:
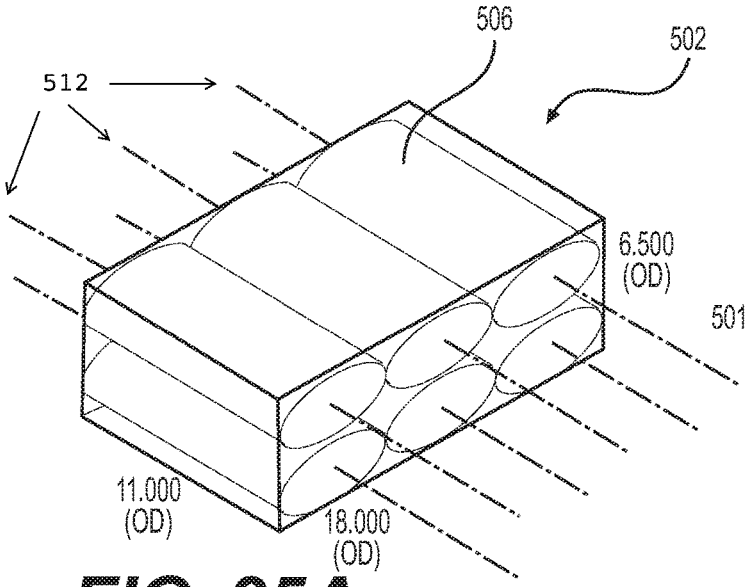
FIGS. 25A through 25E schematically illustrate a packing scheme in which poly-wrapped 6 roll packs of un-cored compressed kitchen roll towel are palletized in cartons yielding another particularly efficient truckload of tissue.
Figure 25B:
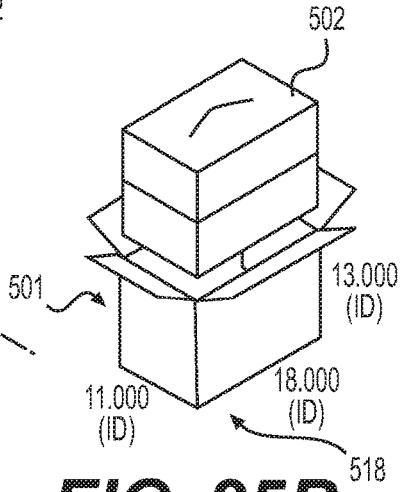
Figure 25C:
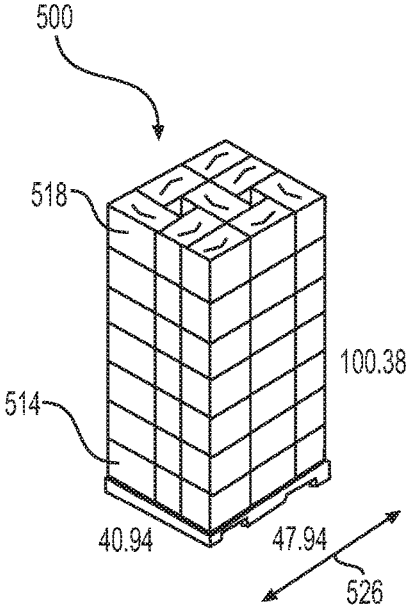
Figure 25D:
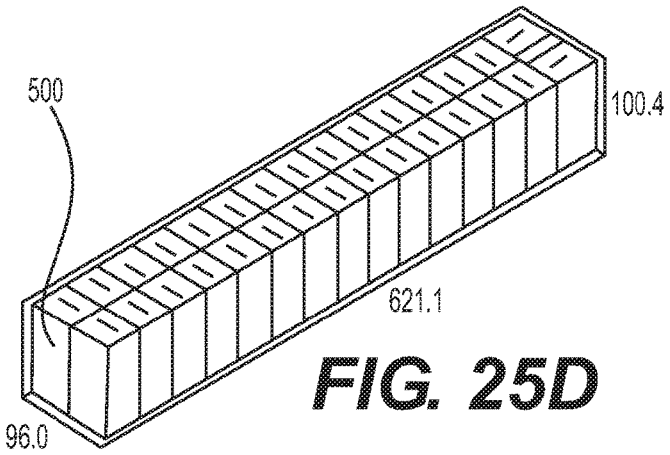
Figure 25E:
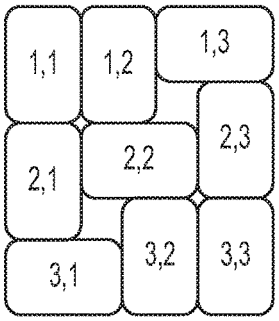
Figure 26A:
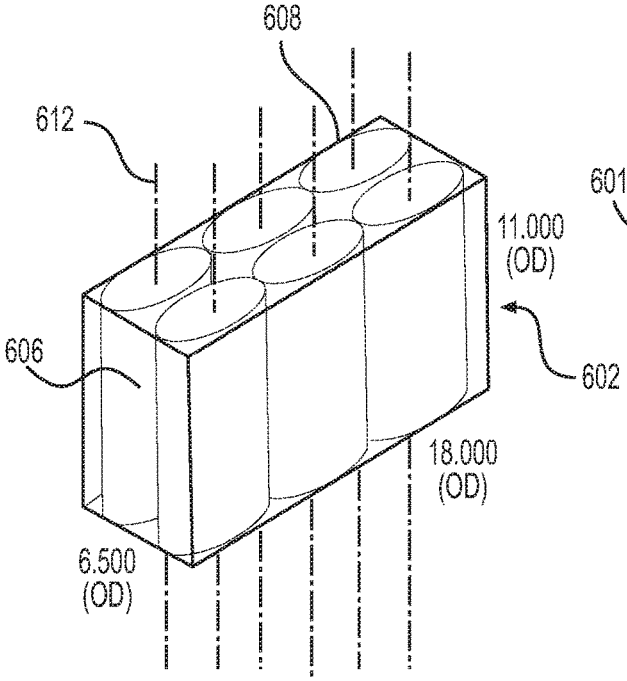
FIGS. 26A through 26D schematically illustrate a packing scheme in which poly-wrapped 6 roll packs of un-cored compressed kitchen roll towel are palletized in cartons yielding another particularly efficient truckload of tissue.
Figure 26B:
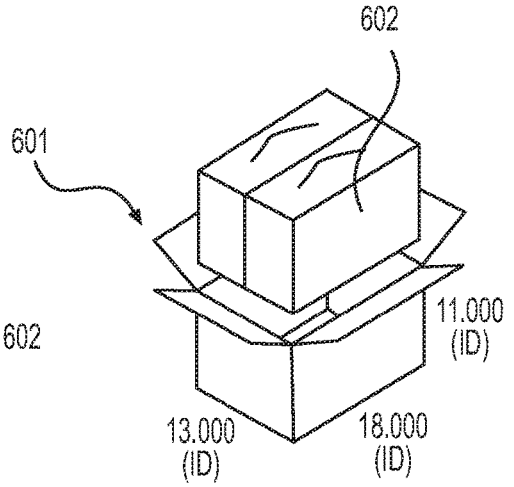
Figure 26C:
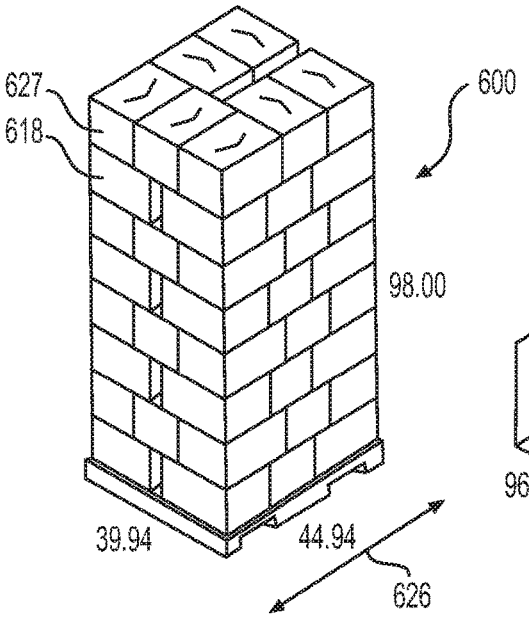
Figure 26D:
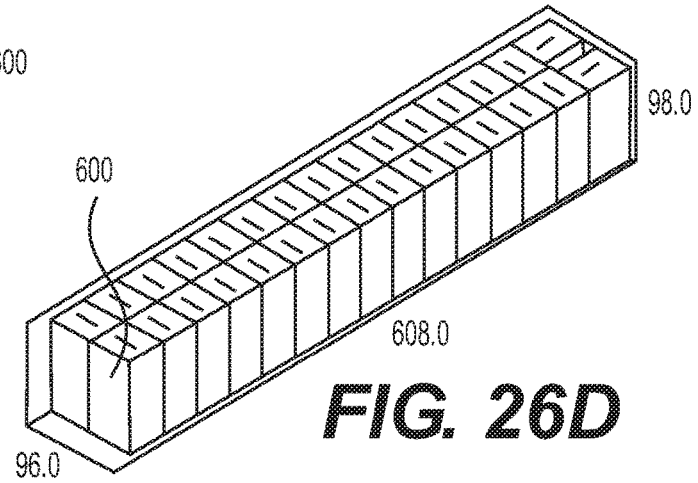

FIGS. 25A-D illustrate a packaging configuration in which pallet 500 cartons 501, preferably carry cartons, in layers 514, in which each carton 501 contains 2 poly wrap packs 502 of 6 compressed hollow roll products 506, preferably coreless re-formable roll kitchen roll towels, of the present invention. Each poly wrap pack 502 comprises 3 columns of rolls 506 in a 3×2 array of rolls 506 with long side 508 of each roll 506 aligned with the 3 deep dimension of the array. Each corrugate container 501 contains 2 poly wrap packs 502 in a vertical array with axis 512 of each roll 506 being horizontal. Each layer 514 comprises 9 cartons 506 in a 3×3 columnar array with 6 cartons 501 having long side 518 of each carton being parallel to long axis 526 of pallet 500 occupying the 1,1; 2,1; 1,2; 3,2; 2,3 and 3,3 positions of the array and 3 cartons 501 having long side 518 perpendicular to long axis of pallet 500, these 3 cartons 506 occupying the 1,3; 2,2 and 3,1 positions of the array. FIG. 25E illustrates the nomenclature for the array. The same benefits can be obtained when 6 cartons 501 having long side 518 of each carton being parallel to long axis 526 of pallet 500 occupy the 1,2; 1,3; 3,2; 3,1; 2,2 and 2,3 positions, which can be referred to as left handed and the first conformation can be referred to as right handed. In each case, it will be noted that there will be two voids 511 in each layer. Further, left-handed and right-handed layers can be intermixed or alternated without any loss of the benefits. When the trailer is loaded, it will often be convenient to turn two pallets 500 with their long directions parallel to the length of the trailer. Although this is not required to obtain the benefits of the invention, it can help restrict longitudinal movement of pallets 500.

FIGS. 26A-D illustrate a packaging configuration in which pallet 600 cartons 601, preferably carry cartons, in layers, in which each carton 601 contains 2 poly wrap packs 602 of 6 compressed hollow coreless re-formable roll products 606 of the present invention. Each poly wrap pack 602 comprises 6 rolls 606 in a 3×2 array with long side 608 of each roll 606 aligned with the 3 deep dimension of the array. Each corrugate container 601 contains 2 poly wrap packs 602 in a side by side array with axis 612 of each roll 606 being vertical. Each layer comprises 7 cartons 606 in an array with 3 cartons 601 in line having long side 618 by long side 618 with each long side 618 also being parallel to long axis 626 of pallet 600, two pair of cartons 601 having long side 618 thereof normal to long axis 626 of pallet 600, with a long side 618 of one carton 601 of each pair abutting interior short sides 627 of said 3 cartons 601 in line, interior short sides 627 of these 2 pairs of cartons 606 being spaced apart from each other, and, the other carton 601 of each pair having one long side 618 facing outwardly from said layer of cartons 601. When the trailer is loaded, it will often be convenient to turn two pallets 600 with their long directions parallel to the length of the trailer. Although this is not required to obtain the benefits of the invention, it can help restrict longitudinal movement of pallets 600.

In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

That which is claimed:

1. A method of making and packaging a compressed hollow coreless roll of absorbent paper sheet comprising:

providing a roll of absorbent paper sheet by winding the sheet about a forming core member having a diameter in the range of 30 mm to 75 mm;

removing the forming core member such that there is provided a hollow coreless roll of absorbent paper sheet with an axial cavity having a diameter in the range of 30 mm to 75 mm;

compressing the hollow coreless roll with opposing forces bearing against opposing lateral surfaces of the hollow coreless roll, such that the axial cavity is substantially collapsed into an elliptical void having opposing long side walls that are planar and parallel to each other and in surface contact with one another over at least 60% of their area; and packaging the compressed hollow coreless roll so that the axial cavity of the compressed hollow coreless roll is maintained in the substantially collapsed configuration.

2. The method according to claim 1, wherein the forming core member has a diameter of from about 35 mm to 50 mm such that the axial cavity of the roll has a diameter of from 35 mm to 50 mm prior to compression of the roll.

3. The method according to claim 1, wherein the forming core member has a diameter of from about 37.5 mm to 42.5 mm such that the axial cavity of the roll has a diameter of from 37.5 mm to 42.5 mm prior to compression of the roll.

4. The method according to claim 1, wherein the forming core member is a tubular paperboard core.

5. The method according to claim 1, wherein the compressed hollow coreless roll is overwrapped with a polymeric film in order to maintain the compressed hollow coreless roll in the substantially collapsed configuration.

6. The method according to claim 1, wherein the hollow coreless tissue roll has a diameter of from about 80 mm to 230 mm prior to compression, and a thickness, after compression such that its axial cavity is substantially collapsed, of no more than about 60% of the diameter of the roll prior to compression.

7. The method according to claim 1, wherein the hollow coreless tissue roll has a diameter of from about 80 mm to 150 mm prior to compression, and a thickness, after compression such that its axial cavity is substantially collapsed, of no more than about 50% of the diameter of the roll prior to compression.

8. The method according to claim 1, wherein the hollow coreless tissue roll has a diameter of from about 100 mm to 130 mm prior to compression and a thickness after compression such that its axial cavity is substantially collapsed, of no more than about 60% of the diameter of the roll prior to compression.

9. The method according to claim 1, wherein the hollow coreless tissue roll has a diameter of from about 100 mm to 200 mm prior to compression and a thickness after compression such that its axial cavity is substantially collapsed, of no more than about 80% of the diameter of the roll prior to compression.

10. The method according to claim 1, wherein a plurality of the compressed hollow coreless rolls are overwrapped with a polymeric film to form a package of the plurality of rolls, wherein the polymeric film is effective to maintain the axial cavities of the plurality of hollow coreless rolls in the substantially collapsed configuration.

11. The method according to claim 10, wherein the package contains a re-usable tubular dispensing core which has a diameter smaller than the forming core member upon which the roll was wound.

12. The method according to claim 11, wherein the tubular dispensing core has a diameter of from 25 mm to 32 mm.

13. The method according to claim 1, wherein either:

the opposing forces are imposed on the hollow coreless roll by at least one piston; or the opposing forces are imposed on the hollow coreless roll by a pair of opposing pistons.

14. A method of delivering absorbent paper sheets comprising:

providing a roll of absorbent paper sheet by winding the sheet about a forming core member having a diameter in the range of 30 mm to 75 mm;

removing the forming core member such that there is provided a hollow coreless roll of absorbent paper sheet with an axial cavity having a diameter in the range of 30 mm to 75 mm;

compressing the hollow coreless roll such that the axial cavity is substantially collapsed, wherein the compressing occurs via opposing forces bearing against opposing lateral surfaces of the hollow coreless roll to produce an elliptical void having opposing long side walls that are planar and parallel to each other;

packaging the compressed hollow coreless roll so that the axial cavity of the compressed hollow coreless roll is maintained in a substantially collapsed configuration that has the opposing long side walls of the elliptical void in surface contact over at least 60% of their area;

re-forming the compressed roll by expanding the substantially collapsed axial cavity;

mounting the re-formed compressed roll about a spindle; and dispensing absorbent sheet from the outer periphery of the re-formed roll.

15. The method according to claim 14, further comprising inserting a tubular dispensing core into the reformed hollow coreless roll prior to mounting the roll about the spindle wherein the tubular dispensing core has a diameter smaller than the core member upon which the roll was wound.

16. The method according to claim 15, wherein the tubular dispensing core has a diameter of from 25 mm to 32 mm.

17. The method according to claim 14, wherein the forming core member has a diameter of from about 35 mm to 55 mm such that the axial cavity of the core has a diameter of from 35 mm to 50 mm prior to compression of the roll.

18. The method according to claim 14, wherein the forming core member has a diameter of from about 37.5 mm to 42.5 mm such that the axial cavity of the core has a diameter of from 37.5 mm to 42.5 mm prior to compression of the roll.

19. The method according to claim 14, wherein the forming core member is a tubular paperboard core.

20. The method according to claim 14, wherein the hollow coreless tissue roll has a diameter of from about 80 mm to 230 mm prior to compression, and a thickness, after compression such that its axial cavity is substantially collapsed, of no more than about 60% of the diameter of the roll prior to compression.

21. The method according to claim 14, wherein the hollow coreless tissue roll has a diameter of from about 80 mm to 230 mm prior to compression, and a thickness after compression such that its axial cavity is substantially collapsed, of no more than about 50% of the diameter of the roll prior to compression.

22. The method according to claim 14, wherein the hollow coreless tissue roll has a diameter of from about 100 mm to 200 mm prior to compression and a thickness after compression such that its axial cavity is substantially collapsed of no more than about 80% of the diameter of the roll prior to compression.

23. The method according to claim 14, wherein either:

the opposing forces are imposed on the hollow coreless roll by at least one piston; or the opposing forces are imposed on the hollow coreless roll by a pair of opposing pistons.

* * * * *